US005418507A

United States Patent [19]

Keane et al.

[11] Patent Number: 5,418,507

[45] Date of Patent: * May 23, 1995

[54] YIG TUNED HIGH PERFORMANCE FILTERS USING FULL LOOP, NONRECIPROCAL COUPLING

[75] Inventors: William J. Keane, San Jose; Christopher F. Schiebold, Palo Alto; Dirk M. Hoekstra, Los Altos, all of Calif.

[73] Assignee: Litton Systems, Inc.

[ * ] Notice: The portion of the term of this patent subsequent to Jun. 22, 2010 has been disclaimed.

[21] Appl. No.: 958,265

[22] Filed: Oct. 8, 1992

Related U.S. Application Data

[63] Continuation-in-part of Ser. No. 783,455, Oct. 24, 1991, Pat. No. 5,221,912.

[51] Int. Cl.[6] ..... H01P 1/218

[52] U.S. Cl. ..... 333/202; 333/219.2

[58] Field of Search ..... 333/202, 207, 219, 219.2, 333/176, 235

[56] References Cited

U.S. PATENT DOCUMENTS

| | | | |
|---|---|---|---|
| 4,179,674 | 12/1979 | Keane et al. | 333/204 |
| 4,480,238 | 10/1984 | Iwasaki | 333/219.2 X |
| 4,500,858 | 2/1985 | Mezak | 333/219.2 X |
| 5,221,912 | 6/1993 | Keane et al. | 333/219.2 X |

OTHER PUBLICATIONS

Keane, "Narrow-Band YIG Filters and Wide-open Receivers", Microwaves, Sep. 1978.

*Primary Examiner*—Seungsook Ham

*Attorney, Agent, or Firm*—Ron Fish; Falk, Vestal & Fish

[57] ABSTRACT

A nonreciprocally coupled ferrimagnetic band reject and bandpass filter having passbands from 2–18 GHz and 6–18 GHz respectively. The band reject filter comprises one or more ferrimagnetic spheres shielded from each other by placement in nonmagnetic, electrically conductive cavities in a block placed in the flux gap of a tuning magnet. Nonreciprocal coupling is achieved by using full RF coupling loops and establishing all factors that affect the transmission line delay for travel of signals from one point in the filter to another such as loop length and size, cavity size, sphere size and spacing, dielectric constant, RF coupling loop wire size and spacing etc. such that the effective electrical length from the center of one full RF coupling loop to the centerline of the neighboring RF coupling loop is $\frac{1}{4}$ wavelength, i.e., an electrical phase change of 90 degrees occurs, and by placing the ferrimagnetic spheres outside the planes of their respective RF coupling loops to minimize the effect of (2,2,0) Walker modes. A ferrimagnetic passband filter comprises at least an input ferrimagnetic sphere in a cavity and an output ferrimagnetic sphere in a cavity in a nonmagnetic, conductive block located in the flux gap of a tuning magnet. Both the input and output spheres are coupled to full RF coupling loops coupling an RF input and an RF output, respectively, to the ferrimagnetic spheres and to ground. The effective electrical length between the RF input or RF output and ground through the respective RF coupling loops is $\frac{1}{4}$ wavelength. Coupling is set tight to achieve wide bandwidth. The ferrimagnetic spheres are offset from the plane of the loop to achieve nonreciprocal coupling thereby allowing the (2,2,0) Walker mode spurious responses to be eliminated from the tunable passband.

20 Claims, 9 Drawing Sheets

YIG TUNED HIGH PERFORMANCE FILTERS USING FULL LOOP, NONRECIPROCAL COUPLING

This is a continuation-in-part of a U.S. patent application entitled YIG TUNED HIGH PERFORMANCE BAND REJECT FILTER, filed Oct. 24, 1991, Ser. No. 7/783,455 (U.S. Pat. No. 5,221,912).

BACKGROUND OF THE INVENTION

The invention pertains generally to the field of filters useful in the 2 to 18 Gigahertz (hereafter GHz) range, and, more particularly, to tunable band reject and bandpass filters using yttrium-iron-garnet (hereafter YIG) ferrimagnetic tuning spheres.

In high frequency receiver systems operating in electrically noisy or hostile environments, it is often useful to have "wide-open" receiver systems which can pick up signals throughout a large band of frequencies. Frequently in such wide-open receiver systems, undesired signals can appear in the band. The unwanted signals can create an annoying interference or render the receiver system inoperable by saturating the input amplifier stages thereby blinding the system to desired signals.

To reduce or eliminate the effects of these unwanted signals, a class of tunable high frequency notch filters grew up. The purpose of this type of filter is to reject energy in an electronically tunable band of frequencies which is typically 25–50 megahertz (hereafter MHz) wide. This reject or stop band has a center frequency which is ideally tunable throughout the range of frequencies for which the receiver system is designed.

Designing a tunable notch filter which has a deep, narrow notch that can be tuned over a broad bandwidth is a difficult challenge. Approaches which were tried and which failed in the 1978 time period were mechanically tuned notch filters and switched, fixed-frequency filters. The mechanical filters failed because of poor reliability, limited tuning range and high costs. The banks of switched, fixed-frequency filters failed for similar reasons.

In response to these shortcomings, a class of YIG tuned notch filters were developed. All YIG notch filters are basically comprised of a transmission line structure which carries the RF signal to be applied to the receiver input and several YIG spheres which are coupled to the transmission line by RF coupling loops at points along the length. Although many different species of these YIG filters exist, they all have certain common characteristics. Typically the YIG spheres are coupled to the transmission line by half or full loops which create radio frequency (RF) magnetic fields which engulf the spheres. The YIG spheres act like tuned circuits, i.e., an inductor connected to a capacitor. Tuned circuits have a resonance frequency at which the impedance of the tuned circuit changes drastically from the impedance at frequencies other than the resonance frequency. A tuned circuit with the inductor and capacitor connected in parallel has a combined impedance which peaks, i.e., reaches its highest value, at the resonance frequency. A series tuned circuit has the inductor connected in series with the capacitor. In these types of tuned circuits, the combined impedance reaches a minimum at the resonance frequency.

Typically, the YIG spheres of a tunable notch or band reject filter are used as both parallel tuned circuits in "series" with the transmission line and as series tuned circuits coupled in "shunt" to the transmission line. This is done in prior art YIG filters by connecting the RF coupling loops together by one-quarter wavelength transmission line sections usually in the form of 50-ohm stripline formed on a substrate. These one-quarter wavelength sections are used as impedance transformers to effectively convert the electrical equivalent circuit of every other YIG sphere from a series-connected, parallel tuned circuit to a shunt-connected, series tuned circuit. The overall electrical equivalent circuit for the resulting YIG tuned notch filter is then a series of series-connected parallel tuned circuits separated by a number of shunt-connected series tuned circuits.

The resonance frequencies of all the tuned circuits in the above-described structure are all at the same frequency because all the YIG spheres are typically subjected to the same D.C. bias tuning magnetic field. That is, in this prior art structure, all the YIG spheres are typically placed in the same magnetic gap between two magnetic pole pieces. These magnetic pole pieces typically have coils of wire wrapped around them that carry a D.C. bias current. This current creates a steady magnetic field which is designed to be uniform throughout the gap between the magnetic pole pieces. This magnetic field envelopes the YIG spheres and magnetically biases each YIG sphere to have the same electrical resonance frequency. By changing the amount of D.C. bias current flowing through the magnet coils, the resonance frequencies of all the YIG spheres can be simultaneously tuned to the same, selected center frequency where the notch is desired.

The effect this has on the wide spectrum of RF frequencies passing through the YIG, notch filter (hereafter the passband) is to "cut a notch" in the passband. This notch is caused mainly by a high mismatch at the resonance frequency, i.e., the notch center frequency of the series-connected, parallel tuned circuit which reflects RF by virtue of being an "open circuit" in which no energy can pass and the low impedance to ground of the shunt-connected, series tuned circuit which reflects RF by virtue of being a short circuit through which no energy passes. That is, for a relatively small (typically 25–50 MHz wide) notch band, centered about the resonant frequency of the YIG spheres, the YIG spheres attenuate RF signals such that substantially less RF energy having frequencies in the notch band leave the YIG filter than entered it.

FIG. 1 is a block diagram of a typical prior art YIG stopband or notch filter application and FIG. 2 is a graph of YIG notch filter performance which illustrates the above-described phenomenon. In FIG. 1, an antenna 10 captures RF energy over a wide band of frequencies, say, for example, 2–18 GHz. This RF energy is guided to the input 11 of a YIG notch filter 12 which has a tunable center frequency for its stopband. This tunable notch or stopband is shown at 14 in FIG. 2. The vertical axis in FIG. 2 represents the attenuation loss imposed by the YIG filter on RF energy having the frequencies covered by the horizontal axis. The downward direction along the vertical axis represents increasing attenuation. RF energy in the stopband 14 at input 11 is reflected back toward the antenna or absorbed by the losses in the filter.

The resulting filtered RF energy, now lacking the RF signals that were within the stopband 14, is then guided to the input of a wide-open type receiver system symbolized by block 16. The receiver then outputs appropriate signals for use by a user via a user interface 18.

In FIG. 2, the frequency range from point 20 to point 22 represents the range of frequencies called the passband which the receiver 16 can detect. Assume now that an interfering signal at frequency F is detected and it is desirable to remove it. In such a case, a tuning command may be issued on line 24 either from the receiver 16 (such receivers typically have alarm circuits which help detect interfering signals) or from the user interface 18. This tuning signal will alter the level of D.C. bias current flowing through the magnet coils in the YIG filter 12 until the center frequency $F_c$ of the notch 14 is shifted so as to match the frequency (or center frequency) F or the interfering signal. The attenuation in the stopband of notch 14 then removes the interfering signal from the spectrum of RF energy which appears at the input of the receiver.

FIG. 3 represents the electrical equivalent circuit of the YIG notch filter. The equivalent circuit of FIG. 3 represents a three sphere YIG notch filter. Assume that the spheres are numbered 1 through 3 in order from the RF input 26 to the RF output 28. YIG spheres 1 and 3 have the series-connected, parallel tuned circuit equivalent circuit shown generally at 30 and 32, respectively. YIG spheres 1 and 3 are each connected to YIG sphere 2 in prior art YIG filters by one-quarter wavelength transmission line sections symbolized by lines 34 and 36. These sections convert the equivalent circuit of sphere 2, also shown as a parallel-tuned circuit, to a shunt-connected, series tuned circuit 38. If the YIG spheres were to be removed, the tuned circuits would disappear from the equivalent circuit of FIG. 3, and the resulting equivalent circuit would be a straight through transmission line coupling the input 26 to the output 28.

Typically, the antenna 10 and the input of the receiver 16 in FIG. 1 are designed to have a characteristic impedance $Z_0$ of 50 ohms, which is an industry compatibility standard. It is axiomatic in electrical engineering that to maximize the efficiency of power transfer from the antenna to the receiver, one must match the output impedance of the antenna to the input impedance of the receiver. Likewise, where a YIG filter is placed between the input of the receiver and the antenna, to maximize the efficiency of power transfer from the antenna to the receiver, it is necessary that the YIG filter have an input impedance that matches the output impedance of the antenna and an output impedance which matches the input impedance of the receiver. If the input impedance of the YIG filter at 11 in FIG. 1, does not match the output impedance of the antenna (or the intervening transmission line), RF power is reflected back toward the antenna thereby creating a voltage standing wave in transmission line 40. The voltage standing wave ratio or VSWR is a measure of the degree of impedance mismatch.

The graph of FIG. 2, shows several small notches at 42 and 44. These notches are undesirable side effects called spurious responses or modes which are intrinsic to the use of YIG spheres. The most troublesome spurious response is the (2,2,0) Walker mode (also referred to herein as the 220 mode or 220 spurious response). It is desirable to eliminate these spurious responses.

It is also important for the YIG filter to attenuate the passband RF energy at frequencies on either side of the notch as little as possible. Any undesired attenuation is called insertion loss.

Thus, a good YIG notch filter will have the following characteristics: 1) a good impedance match with the devices coupled to its input and output, i.e., low VSWR, 2) low insertion loss, 3) minimal spurious responses, 4) deep notches of 25 to 50 MHz bandwidth, with a high Q factor, 5) agile, fast notch tuning throughout the passband, 6) predictable stopband characteristics, 7) a wide passband wherein the above stated characteristics remain within an acceptable range throughout the passband.

Workers in the art have been trying to achieve all of the above characteristics in a single design that covers a 2–18 GHz passband for many years. Several major problems exist which make achievement of all the above objectives over a passband of 2–18 GHz very difficult.

First, the physical length of the one-quarter wavelength impedance inverter is only correct at one frequency in the passband. At other frequencies, the inverters are not one-quarter wavelength long so the desired 90° phase shift of a true one-quarter wavelength is not achieved exactly. Further, the one-quarter wavelength striplines impose increased insertion loss because of their non-air dielectrics.

Second, the bandwidth of the stopband or notch is dependent upon the loop coupling, with greater coupling giving a wider notch which is considered desirable by workers skilled in this art. Generally, full loop coupling where the YIG spheres are surrounded by full loops as opposed to half loops gives a wider notch.

Full loop coupling also has two other advantages which make its use throughout the notch tuning range highly desirable. First, full loop coupling is not nearly as sensitive to manufacturing errors in positioning of the sphere within the coupling loop. Second, full loop coupling does not generate as many spurious responses. With half loop coupling, a small positioning error in positioning of the YIG sphere within the half loop leads to a substantial change in the overall coupling. Full loops do not suffer from this problem since a positioning error leads to tighter coupling between the YIG sphere and one portion of the loop and looser coupling between the sphere and another part of the loop opposite the part of the loop with tighter coupling. The overall coupling remains approximately the same as it would have been absent the positioning error. Fewer spurious responses result from full loop coupling, because this type of coupling is more symmetrical than half-loop coupling. Spurious responses are generally caused by asymmetrical coupling.

The problem with full loop coupling is that the full loops have more inductance than half loops and this extra inductance is too high to be effectively compensated by shunt capacitance at the high end of the passband. The inductance of the coupling loops periodically loads down the transmission line throughout structure of the YIG notch filter at the locations of the YIG spheres and therefore affects the passband by dominating the characteristic impedance of the transmission line from the YIG filter RF input to its RF output, The characteristic impedance of a transmission line is:

$$Z_0=\sqrt{LC}$$

where, $Z_0$=the characteristic impedance per unit length, i.e., per section

L=the inductance per unit length

C=the capacitance per unit length.

Inductive reactance varies directly with frequency. Thus the reactance of a coil of wire increases as the RF frequency feeding the coil increases. This is the reason all attempts in the prior art to use full loop coupling at the 18 GHz end of the passband have failed until now. At these high frequencies, the inductance of the full loop coupling coils was so high that it was impossible to add enough capacitance per section to hold the characteristic impedance down to the industry standard 50 ohms over a wide range of frequencies. The impedance mismatch resulted in part of the desired RF energy in the passband outside the notch being reflected back toward the antenna. This caused an unacceptably high VSWR value.

As a result, in the prior art, different filter structures were used for different frequency ranges. In the early years of YIG filter design, YIG notch filters with full loop coupling were designed to operate in the range from 2–4 GHz. Another design was used for the range from 4–8 GHz and another design was used for the range from 8–18 GHz generally employing only half loop RF coupling. Generally, the length of the one-quarter wavelength sections was made smaller for the higher frequency designs and the coupling was changed from full loop at the low frequencies to half loop at the higher frequencies. It was necessary to shorten the one-quarter wavelength sections at the higher frequency to avoid the distortion in the notch shape which would otherwise result. The switch to half loop coupling at the high frequencies was necessary to keep the input and output impedances of the YIG filter near 50 ohms, but it also resulted in greater spurious responses.

Eventually, workers in the art determined that since the use of more YIG spheres gave a deeper notch, it was possible to stretch the design of a YIG filter such that one or possibly two designs could be used to cover the whole passband from 2–18 GHz simply by using more spheres. Thus, even though the performance steadily degraded at the lower frequencies, useable performance levels could still be obtained. That is, performance which was adequate to meet the specifications of customers was obtainable since more than enough notch attenuation and stopband bandwidth at the high frequencies was available and the degradation at lower frequencies was not enough to take the performance out of the acceptable range. However, none of these designs in the prior art were capable of using full loop coupling at the high frequency end of the passband, because of VSWR problems caused by the increasing inductive reactance of the full loops at high frequencies. As a result, to date no designer of YIG filters has been able to use full loop coupling to the YIG spheres in the high end of the passband near 18 GHz.

A short history of the various specific approaches that have been tried in the prior art is in order so as to better frame the subject and provide greater appreciation for the differences over the prior art of the approach taught herein according to the teachings of the invention. In 1978, the state of YIG filter design was generally as taught by W. J. Keane in his article "Narrow-Band YIG Filters Aid Wide-Open Receivers", published in *Microwaves* in September 1978 at page. 50 which is hereby incorporated by reference. In that article, basic YIG filter designs are discussed as are the various requirements for a good YIG filter design. The concepts of shunt capacitors to control $Z_0$ and VSWR considerations and insertion loss and the desirability of linear phase characteristics throughout the passband are discussed. Also discussed are the relationship between spurious responses and tighter coupling. The tradeoffs between passband and stopband performance are discussed. The distortion in the shape of the notch as it is tuned over the passband caused by non-optimum resonator spacing is also discussed. This article states that the passband design fixes the stopband performance since the size, shape and spacing of the coupling loops that are matched in the transmission line determine the amount of coupling bandwidth achievable with a given size and number of spherical YIG resonators. The article goes on to state that the generation of spurious modes due to nonlinear RF fields in the YIG resonators ultimately limits the minimum sphere-to-loop spacing. This statement assumes that half loop coupling is used, and there is no suggestion that full loop coupling can be used. In fact, this article suggests that since passband performance is paramount, full loop coupling cannot be used at high frequencies since it would cause high VSWR and large insertion losses which would be very disadvantageous. The maximum tuning range without excessive notch shape degradation is suggested to be two octaves.

The state of the art of prior art, full loop YIG notch filter design prior to the invention is probably best understood by referring jointly to FIGS. 4A, 4B and 4C. These figures show a 4-sphere YIG notch filter design using full coupling loops and designed for use in a 2–6 GHz passband. Although frequently 6 to 8 YIG spheres would be used in conventional designs, only 4 spheres are shown here for simplicity. FIG. 4A shows a plan view of the YIG notch filter while FIG. 4B shows an elevation view and FIG. 4C shows the filter in pseudo-schematic form. In this prior art design, the YIG spheres 46, 48, 50 and 52 are supported in a magnet air gap 54 between two circular cross section electromagnet pole pieces 56 and 58 by beryllium oxide support rods 60, 62, 64 and 66 which are anchored in heater blocks (not shown). The pole pieces have wound around them D.C. bias electromagnet coils 68 by which a D.C. magnetic field is created in air gap 54. In the prior art designs symbolized by FIGS. 4A through 4C, the pole pieces 56 and 58 were separated by an air gap which was approximately 0.060 inches across. By changing the intensity of the D.C. magnetic field in this air gap, the resonance frequency of all of the YIG spheres could be simultaneously tuned thereby altering the center frequency of the band reject notch.

The YIG spheres used in prior art designs generally used spheres which were 0.015 to 0.030 inches in diameter. In addition, between each sphere, a 50 ohm microstrip or strip line transmission line was used as an impedance inverter. These microstrip or stripline impedance inverters are symbolized in FIG. 4A by the line between solder joints 71 and 73, the line between solder joints 75 and 77, and by the line between solder joints 79 and 81. The 50 ohm transmission line impedance inverters were fabricated on an insulating substrate (not air) and were designed to be $\frac{1}{4}$ wavelength at some frequency in the desired passband.

Because the impedance of the full coupling loops became very high at 18 GHz, it was impossible in the prior art designs symbolized by FIGS. 4A–4C to match the overall impedance of the coupling structure to the 50 ohm line at the RF input 78 and the RF output 83. The resulting impedance mismatch caused major VSWR problems and higher insertion loss. For these reasons, the full loop designs were not used at 18 GHz. At these higher frequencies, ½ loop coupling straps were used in the prior art as symbolized by FIG. 5 instead of insulated wire. The ½ loops cut down on the available coupling, and caused more spurious modes. Further, they were sensitive to manufacturing errors in placement of the spheres in the centers of their cavities. However, the half loops were easier to match to 50 ohms, because their impedance was less at 18 GHz, and they had proportionally more surface area to capacitively couple to the cavity walls to provide the shunt capacitance C in equation (1) above. Additional capacitive coupling between the coupling loops and the ground plane was provided by grounded, adjustable shim plates of which plates 88 and 90 were typical. These shim plates generally were used to cover the tops of the cavities formed in a metal block like block 89 in FIG. 4B suspended in the air gap 54 which contained the YIG spheres. Capacitive coupling to adjust impedance and VSWR was altered by deforming the shims to push them closer to or further away from the RF coupling loops. Also, the cavities in the prior art designs, of which cavity 91 in FIG. 4B is typical, were spaced much further apart in the prior art designs than the spacing according to the teachings of the invention and were arranged in a circle. Only the cavities of the spheres 46 and 52 of FIG. 4A are visible in the cross section of FIG. 4B with the cavities of the spheres 48 and 50 obscured behind.

The YIG notch filter according to the teachings of the invention is aligned to match all center frequencies of the YIG spheres as closely as possible by rotating all the spheres in their cavities until best performance is achieved.

The structures of FIG. 4A and 5 are the structures upon which the article by W. J. Keane cited above was based. For the high frequency part of the desired passband from 6–18 GHz (typically), the prior art half loop structure FIG. 5 would be used with all other structural details being the same except that sometimes coupling straps were used instead of wires. Since the half loops 80, 82, 84 and 86 have substantially less inductance at the high frequency end of the passband, it is possible to add enough shunt capacitance via shim plates 88, 90 92, 94, 96, 98, 100 and 102 to keep $Z_0$ down to close enough to 50 ohms to result in an acceptable VSWR.

In December of 1979, U.S. Pat. No. 4,179,674 (hereafter the '674 patent) to Keane et al. issued which is hereby incorporated by reference. This patent taught a RF coupling structure for non-reciprocal coupling using half loops and a cover over the YIG spheres to increase the shunt capacitance between the coupling loop and the groundplane. This shunt capacitor produced a phase shift which caused circular or elliptical polarization and was thought to increase the Q from the 100 to 500 values previously achieved to the 20,000 range for both the VHF and microwave ranges. The '674 patent also teaches dividing the RF coupling loop up into two coupling loops which couple to the YIG sphere in a spatially orthogonal fashion with phase orthogonality produced by a divider circuit to produce circular polarization. The '674 patent teaches linear polarization as yielding an absorptive filter. This patent also teaches offsetting the YIG spheres from the plane of the RF coupling loops to generate circular polarization and coupling a shunt capacitor to one of the electrical transmission lines to introduce a 90° electrical phase shift and circular polarization. The '674 patent teaches that by offsetting the YIG sphere and using circular polarization reduces spurious responses. The '674 patent also teaches that offsetting without circular polarization has the opposite effect in producing more spurious responses. The patent also teaches that the sense of the polarization is important in eliminating spurious responses. This depends upon the sense of the static magnetic field, and the side of the loop to which the sphere is offset. A single line YIG sphere offset and a capacitor coupled to the middle of the loop is also taught in FIG. 10 to achieve single line. An adjustable shim casing to vary the shunt capacitance is also taught.

In August 1980, U.S. Pat. No. 4,216,447 to Keane et al. was issued which contained the same teachings as U.S. Pat. No. 4,179,674, but which claims different subject matter.

In January of 1981, U.S. Pat. No. 4,247,837 issued to Mezak, et al. (hereafter the '837 patent) which is hereby incorporated by reference. This patent teaches using multiple conductors in the coupling loop to increase the coupling to the YIG spheres. The multiple conductors of the coupling loop are separated by at least one diameter and are taught to be a superior approach in attempting to get notch bandwidth greater than 35 MHz. Prior approaches to increase the notch bandwidth included bringing the coupling loop closer to the sphere and using a lower inductance conductive strap as opposed to a single wire loop. Both of those prior approaches are taught to have increased "crossing" and "tracking" spurious responses. "Tracking" spurious responses are unwanted spurious mode notches that move with the center frequency of the desired notch. Crossing spurious responses move at rates different than the center frequency of the desired notch. The '837 patent teaches the conventional wisdom that prior attempts to increase the notch bandwidth by increasing the turns in the coupling loop did not work and, therefore, teaches away from the invention. This was because of the increased series inductance in the line from the input to the output which lowered the frequency of the high frequency cutoff end of the passband above which the filter was useless. The '837 patent also teaches that prior attempts to solve this problem included use of a strap and multiple closely spaced or touching wires in the coupling loop both of which approaches have failed because of increased spurious responses.

Significantly, the '837 patent, at Col. 2, lines 2–8 and Col. 6, lines 3–19, teaches that it is disadvantageous to increase the number of turns of the coupling loops because it increases the series inductance in the line between the input and output ports. The '837 patent teaches that use of multiple, separated conductors works better than large diameter wires or straps because less spurious modes are created. The multiple conductors of the '837 patent are used in RF coupling loops only and are not used in the transmission line segments between coupling loops.

In 1986, Watkins-Johnson announced, in the April issue of *Microwave Journal,* an 8-stage, YIG-tuned notch filter with a 60 MHz notch bandwidth and a 6–12 GHz passband. This filter had tracking spurious responses of 4 db (maximum) and a VSWR of 2:1 (maximum). Passband insertion loss was 1 db (maximum). Subsequently, Watkins-Johnson announced, by data sheet, a series of 8-stage, YIG-tuned notch filters that cover various segments of the passband from 0.5 to 26 GHz. Notch bandwidth varied from 5 to 35 MHz with 40 db of rejection and VSWR values ranged from 1.5:1 to 2:1 and insertion loss values ranged from 1 to 2 db. Tracking spurious modes were 4 db maximum.

In April 1989, the then existing state of the prior art in YIG-tuned notch filter design was summarized by W. J. Keane in a design note that was widely circulated to customers for YIG filters. This design note discussed the relative merits of 4-sphere vs. 7-sphere YIG filters and the theoretical tradeoff between band-reject and passband performance. This design note is included herewith as Appendix A.

In this design note, the effect of the fraction of coupling turns of the RF coupling loop on the notch bandwidth is discussed at page 11. There, four different approaches in the prior art are identified for designing the passband for a YIG notch filter. The first approach is to design a loop whose impedance is nominally 50 ohms over its entire length. In this approach, the YIG spheres are placed in cavities with the coupling loops in the cavities positioned between the cavity walls and the sphere. The coupling loops are connected by impedance inverters in the form of 90° lengths of stripline transmission line. The disadvantages of this approach is that it needs a sizeable area to accommodate all the cavities and striplines. This makes the magnet gap large in area and renders it more difficult to achieve equal magnetic flux intensity for all spheres. Large gaps also make rapid tuning of the notch center frequency more difficult since large amounts of magnetic flux need to be changed in flux density level to tune the center frequency. It is believed that Watkins-Johnson uses this approach.

The second prior art approach discussed in the Keane design note is a stripline circuit where the loop inductance is matched using distributed capacitance on both sides of the cavity. However, for large fractional coupling loops, it is difficult to achieve sufficient capacitance to make the match at the high frequency end of the passband. Another disadvantage of this second approach is the fact that the cavities and impedance inverters are not totally shielded, making it difficult to provide isolation between the input and output. This approach could be used at lower frequencies to match a single or multiple turn coupling loop.

The third approach is an iterative matching procedure consisting of a single transmission wire that is periodically loaded by the RF cavity walls. One advantage of this approach is high fractional coupling factor including full or multiple full turn loops. This increases the notch bandwidth and reduces coupling into magnetostatic modes such as the 210 mode. Also, nonreciprocal coupling can be used to suppress several other modes. This approach requires less area for the RF magnet gap and the RF circuit. The insertion loss and VSWR for this approach can be very good depending upon the passband. However, at the time this third approach was developed, the use of the full loop coupling was contemplated only for low frequencies where it was possible to match the line impedance using the casing. The Ferretec design criteria note acknowledges this conventional wisdom at page 15 indicating that designs of the day were generally intended for either a low band of 2–6 GHz or a high band from 6–18 GHz.

The fourth approach consisted of designing a low pass filter structure which combined distributed loop coupling and discrete inter-loop capacitors. This approach is practical for broadband designs only at low frequencies. However, the fractional coupling factor n cannot be as large as with the iterative matching approach. This approach has been used primarily in the low passband range.

In February 1985, the assignee of the present invention made and sold to Watkins-Johnson a YIG notch filter according to the third approach but using a pair of wires to form both the coupling loops and the inter-connecting transmission line segments rather than a single wire. Four YIG spheres and ½ coupling loops were used. Band reject performance was unsatisfactory from 2–16 GHz until the twin wires were soldered together at the midpoint between the spheres 2 and 3. This changed the coupling from "unusual" at 10 and 20 GHz to "normal" at 10 GHz and unusual at 20 GHz. Subsequently, three solder joints were used, one between each loop at the midpoints of the connecting segments. This caused the structure to have normal coupling from 4–26 GHz and behave like a single loop. The notch appeared most symmetric at 14.5 GHz.

Changing the wire diameter from 0.003 inches to 0.0075 inches with three solder joints improved the performance further.

A variant was then tried with the outer sphere 1 and 4 coupled by half loops and the inner spheres coupled by full loops. In this embodiment, the cavity diameter was 0.060 inches and the air gap was 0.060 inches using 0.018 inch diameter YIG spheres. Solder joints were only used at the midpoints of the transitions between the half loops and the full loops. The performance of this combination deteriorated significantly in that the insertion loss climbed from less than 1 dB to greater than 6 dB at 13 GHz. Return loss went from less than 10 dB to approximately 0 dB. This failure further confirmed the Ferretec belief in the conventional wisdom that full loop coupling can only be used in the low frequency end of the passband and was another signpost pointing away from the path which eventually resulted in finding the invention.

The Ferretec structure with half-loop coupling and solder joints between loops was shipped in 1985.

In July of 1990 Watkins-Johnson announced a 10-stage band reject filter in *Microwave Engineering Europe.* This device used a larger number of YIG spheres than had been previously tried. A family of filters built around this concept eventually resulted including filters which cover passbands from 6–18 GHz, from 12–18 GHz and from 6–12 GHz. 40 dB notches with 25 MHz notch width for the passband from 6–18 GHz is available with this family of filters and 40–50 MHz notches for 6-12 and 12–18 GHz is also available.

In all the prior art described above, full coupling loops have never been successfully used in the higher end of the frequency range. Further, it has often been assumed in prior art approaches that a circular configuration of the YIG spheres was necessary so that all spheres would experience the same magnetic field intensity even though the circular configuration is not the most efficient configuration in terms of air gap area required. Probably the biggest problem facing YIG filter designers over the years has been how to handle the spurious (2,2,0) Walker mode. When a YIG sphere resonates, it has a useful 110 mode which can be used to create either a bandpass or band reject filter as described in the '674 patent discussed above. However, the YIG sphere also resonates at harmonic frequencies and these resonances create irksome spurious modes or "spurs" that create unwanted notches in the passband. The '674 patent teaches that nonreciprocal coupling can be used to reduce or eliminate the 220 spurious mode, but it also teaches that the nonreciprocal coupling is generated by the use of circular polarization. The circular polarization is achieved by offsetting the YIG spheres from the plane of the coupling loop to provide spatial orthogonality and coupling a shunt capacitor to the coupling loop to provide a 90 degree phase shift.

Unfortunately, the achievement of circular or elliptical polarization is difficult and unpredictable, and all the ways of doing it taught in the '674 patent were so complicated that nobody in the industry adopted these teachings.

Therefore, a need has arisen for a simple YIG notch filter and bandpass filter design that uses full loop coupling both at the high and low frequencies, and which need not necessarily have the YIG spheres arranged in a circular configuration, and which can achieve nonreciprocal coupling in a predictable manner so as to minimize the effects of the (2,2,0) Walker mode.

SUMMARY OF THE INVENTION

According to the teachings of the invention, a YIG notch filter is constructed for use throughout a typical passband from 4 to 18 GHz (although the teachings of the invention are also useful at lower frequencies) using full coupling loops which are designed to be about one-quarter wavelength long at about 12–13 GHz, and having no one-quarter wavelength transmission line segments between YIG spheres and with the YIG spheres located outside the plane of the coupling loops.

In some embodiments, smaller YIG spheres and smaller cavities with the YIG spheres spaced very close to each other are also used. With doping of the YIG spheres, the passband can be expanded down to 2 GHz.

In the preferred embodiment, the YIG spheres are arranged linearly within the air gap of the D.C. tuning electromagnet, although permanent magnet (PM) biasing, or combinations of PM and D.C. biasing can be used.

No separate one-quarter wavelength transmission lines are used for impedance inversion between the RF coupling loops in the invention. Instead, portions of the RF coupling loops themselves, are used as the one-quarter wavelength impedance inversion sections. Also, no shunt capacitor is needed to achieve nonreciprocal coupling in the invention in contrast to what is taught in the prior art patent U.S. Pat. No. 4,179,674 to Mezak and Keane thereby greatly simplifying the design.

Achievement of nonreciprocal coupling provides another tool to the YIG filter designer. Nonreciprocal coupling not only can be used to reduce the effect of (2,2,0) Walker modes, but it can also be used to increase the effective Q of the YIG spheres at low frequencies around 2 GHz where YIG filters have always performed badly.

Twin wires are used in the coupling loops in the preferred embodiment of a YIG notch filter according to the teachings of the invention. These twin wires are electrically joined by solder joints between spheres. The wires are separated by up to at least one diameter in the preferred embodiment.

Smaller YIG spheres are used in the YIG notch filter than are used in the prior art and they are placed much closer together than in the prior art because of the omission of the one-quarter wavelength transmission line segments between spheres. In addition, the RF coupling loops are placed closer to the cavity walls. The spheres are enclosed within cavities in a non-magnetic block. Because of the smaller spheres, smaller cavities both in terms of their diameter and their height are used. Each cavity is separated from its neighboring cavities by a wall which is 0.010 inches thick.

Generally, the YIG spheres in the prior art design of FIGS. 4A–4C and FIG. 5 were arranged concentrically in a circle within the perimeter of the circular pole pieces and were equidistant from the center of the pole piece such that all the YIG spheres experience the same intensity magnetic field. It was thought according to conventional wisdom, that it was very important for all YIG spheres to experience exactly the same D.C. bias magnetic field intensity, and this led to the circular arrangement. As will be apparent from the below discussion of the teachings of the invention, this circular arrangement of the YIG spheres was abandoned and a linear arrangement of spheres or two parallel lines of spheres are used according to the teachings of the invention.

Because the above described structure is so compact, it has a reduced area in the tuning magnet air gap. This leads to faster tuning because the amount of the magnetic flux which must be changed in intensity is smaller than in conventional designs where the YIG spheres are arranged in a circle. Also, this compactness means that multiple YIG filters, each of multi-sphere construction, can be placed in the same air gap, as well as two independent YIG notch filters that track each other for two channel receivers. This also allows for alternate concepts to be built such as YIG bandpass and YIG notch filters in the same air gap.

The smaller air gap also reduces the amount of power needed to drive the D.C. tuning magnet since the smaller pole piece allows more turns to be used in the tuning coil. In many applications, the amount of power available is limited, so it is advantageous to be able to tune throughout the passband with less power.

A reduced insertion loss results from the use of the air dielectric and the lack of stripline one-quarter wavelength impedance inverters between RF coupling loops. The lower insertion loss allows more stages to be used and allows cascading of individual filters.

The simplicity of a YIG filter design according to the teachings of the invention also lends itself to lower manufacturing costs.

It will be appreciated by those skilled in the art that use of the term "air gap" herein is not intended to restrict the dielectric to air only. Other dielectrics in the cavities and air gap may also be used.

Finally, non-reciprocal techniques are possible to reduce spurious responses and raise the apparent Q at low frequencies. Nonreciprocity is achieved for a band reject filter by establishing full coupling loops coupled in series where the effective RF length from loop centerline to loop centerline for adjacent spheres is $\frac{1}{4}$ wavelength and by offsetting the ferrimagnetic spheres from the centerline of the loops. The effective RF length is established by a number of factors such as the loop length, wire diameter and spacing of the parallel wires that make up the RF coupling loops, the sphere diameter and cavity size relative to the diameter of the loop, the sphere spacing and the dielectric constant of the dielectric filling the cavity. These factors are selected such that the effective RF length of $\frac{1}{4}$ wavelength from loop centerline to loop centerline is established at a frequency above 8 GHz and preferably around 12–13 GHz. The position of each sphere relative to the plane of its RF coupling loop is optimized to maximize the depth of the 110 mode band reject notch and minimize the (2,2,0) Walker mode notches in the passband.

Bandpass filters are also possible with nonreciprocity advantages. Specifically, wide bandwidth passband filters have always had the problem that the (2,2,0) Walker modes can be pulled into the passband and distort it. By making the input and output loops of a bandpass filter full loops with an effective RF length of $\frac{1}{4}$ wavelength at a frequency above 8 GHz and offsetting the ferrimagnetic spheres from the planes of the input and output loops, nonreciprocity may be achieved such that the (2,2,0) Walker modes can be caused to disappear from the passband.

DETAILED DESCRIPTION OF THE PREFERRED EMBODIMENT

Figure 1:
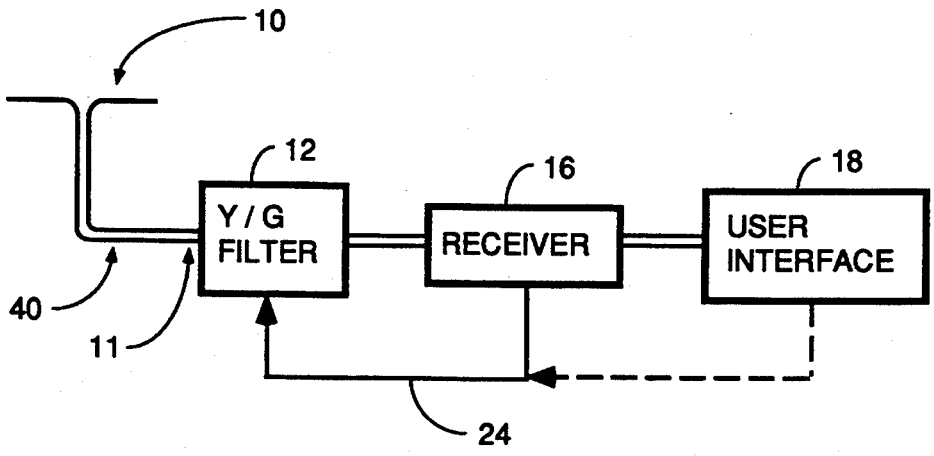
FIG. 1 is a block diagram of a typical receiver system using a YIG band reject filter.
Figure 2:
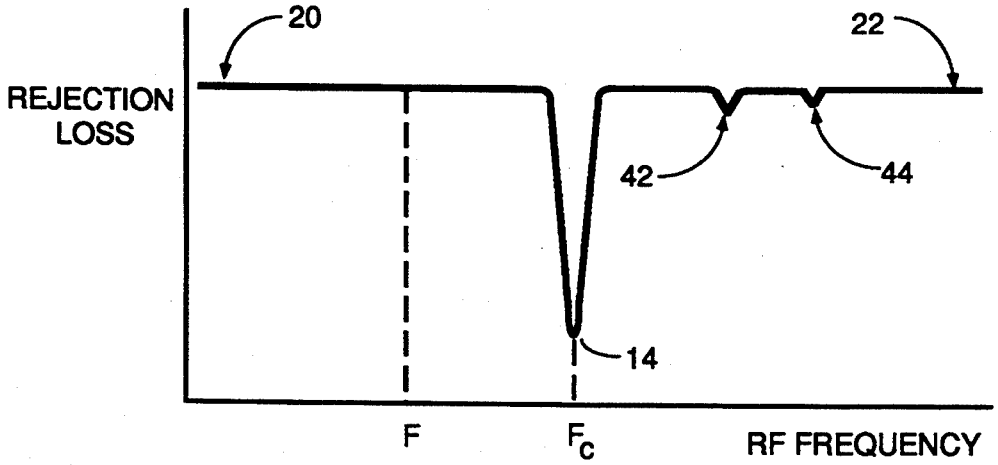
FIG. 2 is a graph of typical bandstop performance of a typical YIG notch filter.
Figure 3:
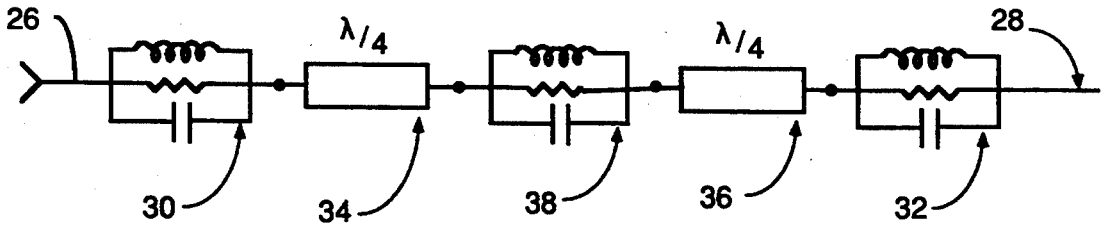
FIG. 3 is an equivalent circuit for a three sphere YIG notch filter.
Figure 4A:
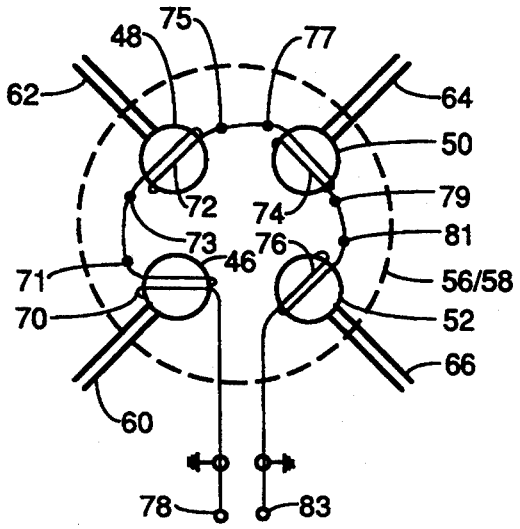
FIG. 4A PRIOR ART
FIG. 4A is a plan view of a typical prior art YIG notch filter.
Figure 4B:
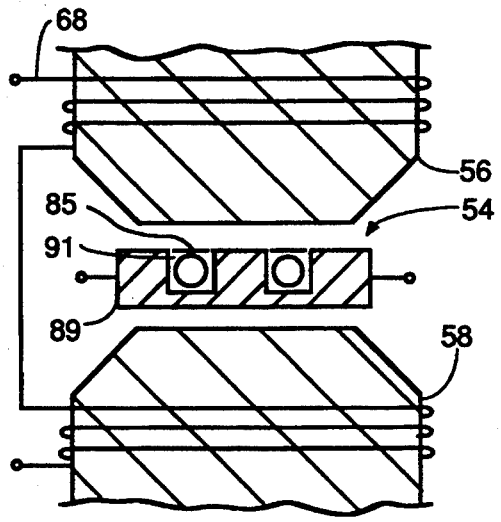
FIG. 4B PRIOR ART
FIG. 4B is an elevation view of a typical prior art YIG notch filter showing the positions of the spheres in the tuning air gap.
Figure 4C:
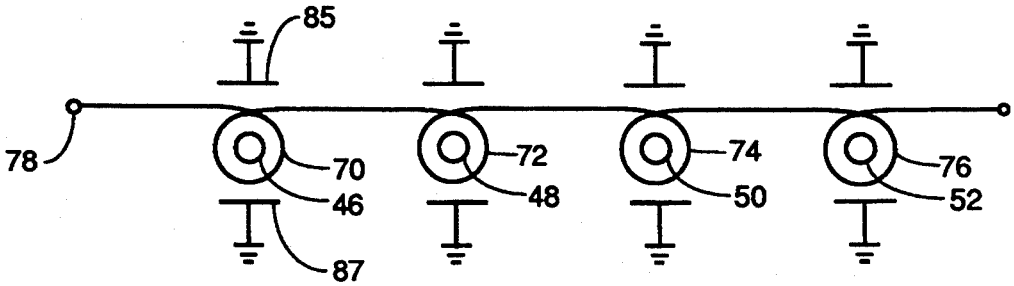
FIG. 4C PRIOR ART
FIG. 4C is a schematic type diagram of a prior art full loop YIG notch filter showing how adjustable shunt capacitance plates were used in the prior art in an attempt to control impedance of the YIG filter to obtain better VSWR values.
Figure 5:
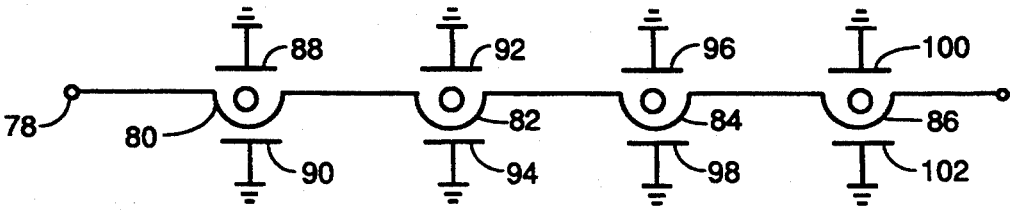
FIG. 5 PRIOR ART
FIG. 5 is a schematic diagram of a half-loop YIG filter design of the prior art using adjustable shunt capacitance plates.
Figure 6:
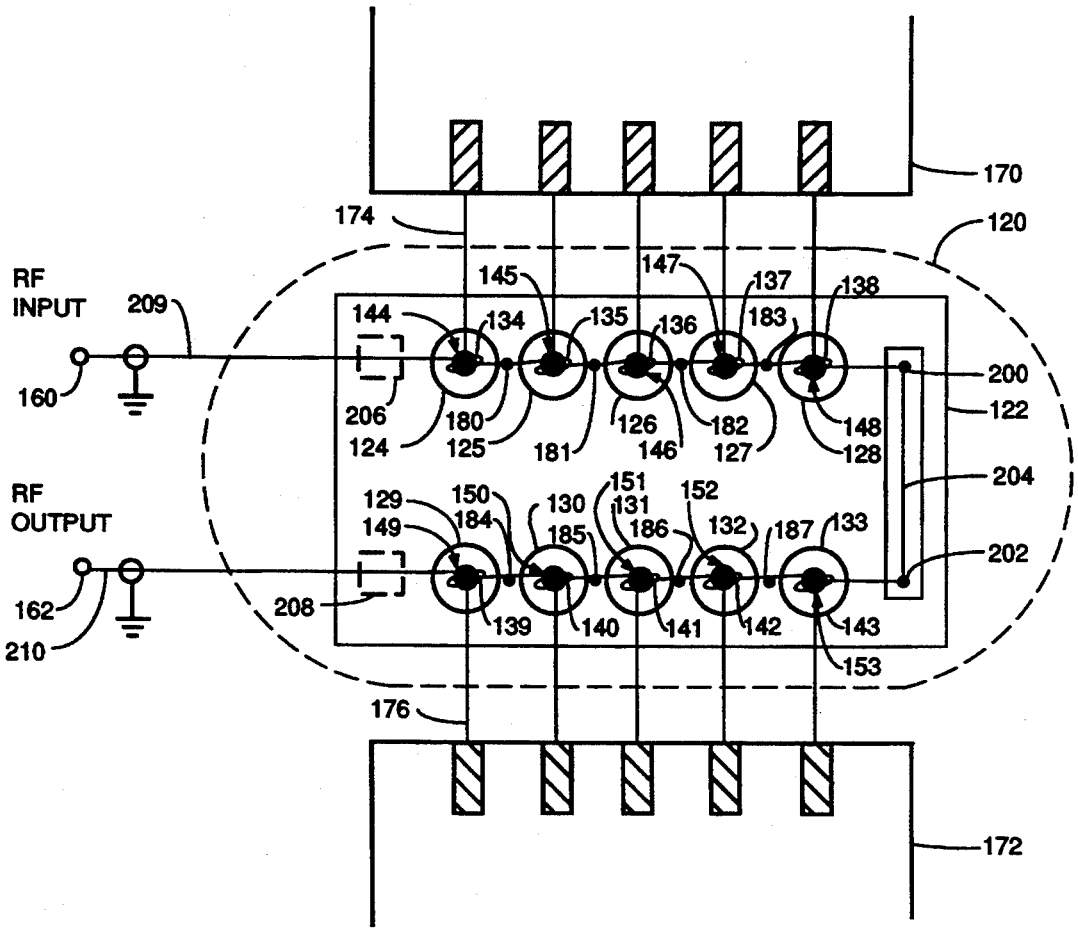
FIG. 6 is a plan view of a 10-sphere YIG notch filter according to the preferred embodiment of the invention.
Figure 7:
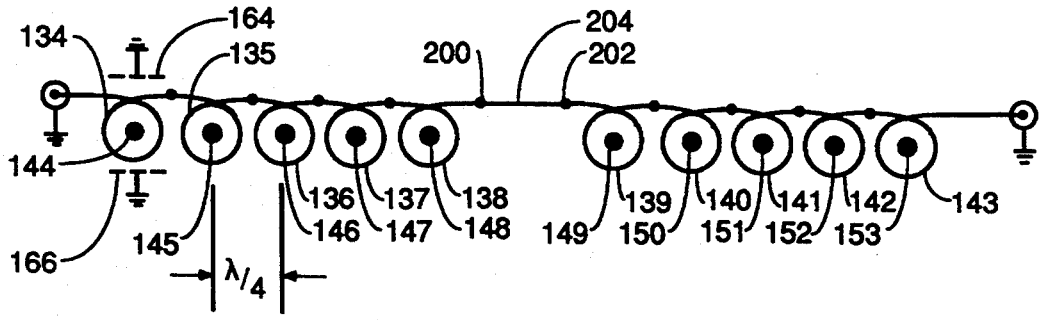
FIG. 7 is a schematic diagram of the filter of FIG. 6.
Figure 8A:
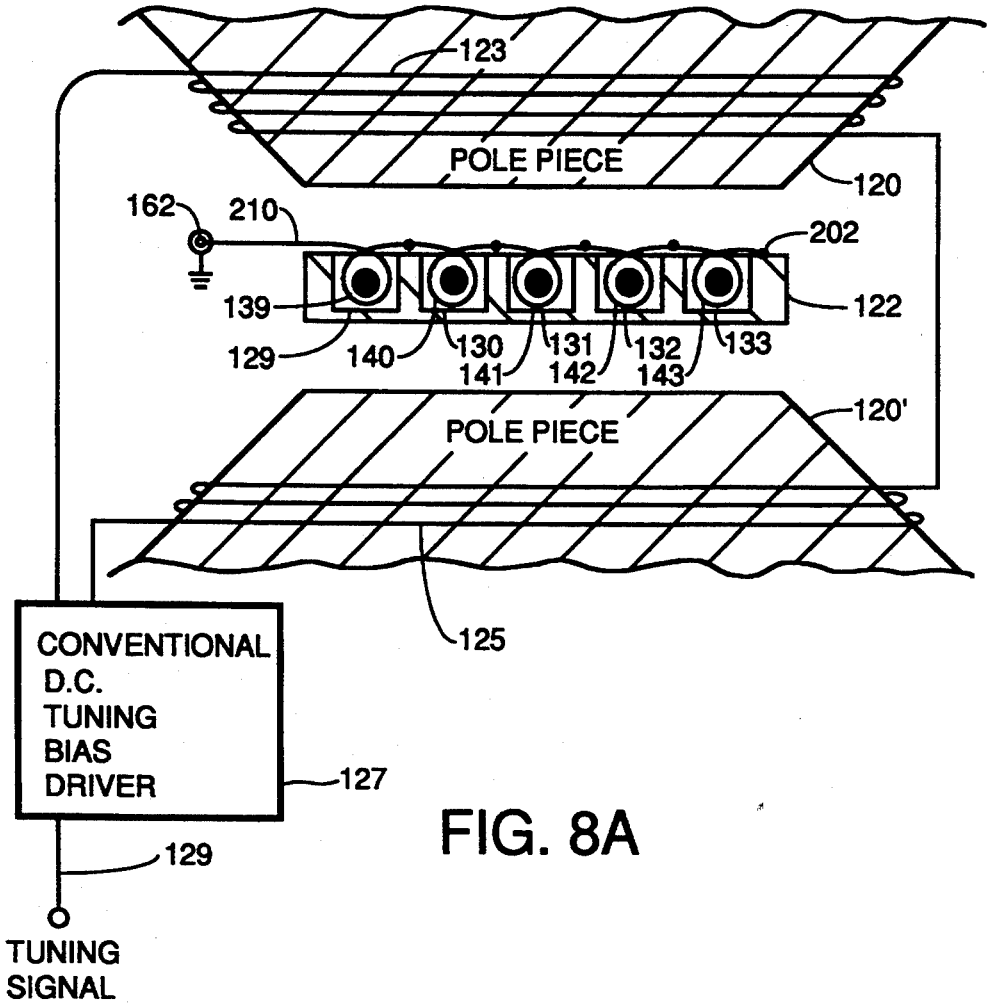
FIG. 8A is an elevation view of a YIG notch filter according to the teachings of the invention.
Figure 8B:
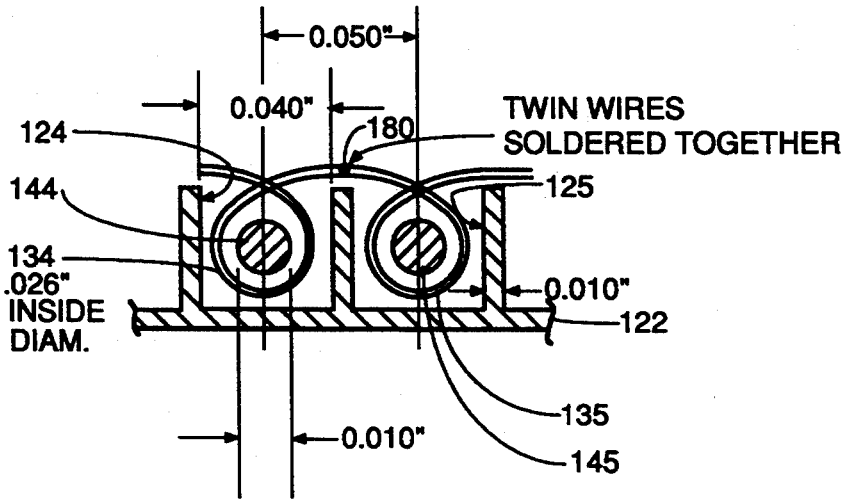
FIG. 8B is an expanded view of the relationships between the YIG spheres, the nonmagnetic block, the RF coupling loops and the cavity walls.

FIGS. 6, 7 and 8 show the preferred embodiment of a YIG notch filter according to the teachings of the invention and designed to operate at frequencies up to 18 GHz. FIG. 6 shows a plan view of a 10 sphere YIG notch filter. FIG. 7 shows a electrical diagram in schematic form of a 10-sphere YIG filter the physical embodiment of which is shown in FIG. 6. FIG. 8A shows an elevation view of the YIG filter shown in plan view in FIG. 6. FIG. 8B shows, in elevation, a close-up view of the YIG spheres in their cavities and the relationship of the RF coupling loops to the cavity walls for two typical YIG spheres. FIG. 8B also shows typical dimensions used in the preferred embodiment of the filter depicted in FIGS. 6 and 8A. Like reference numbers in FIGS. 6, 7, 8A and 8B denote identical structures.

Figure 9:
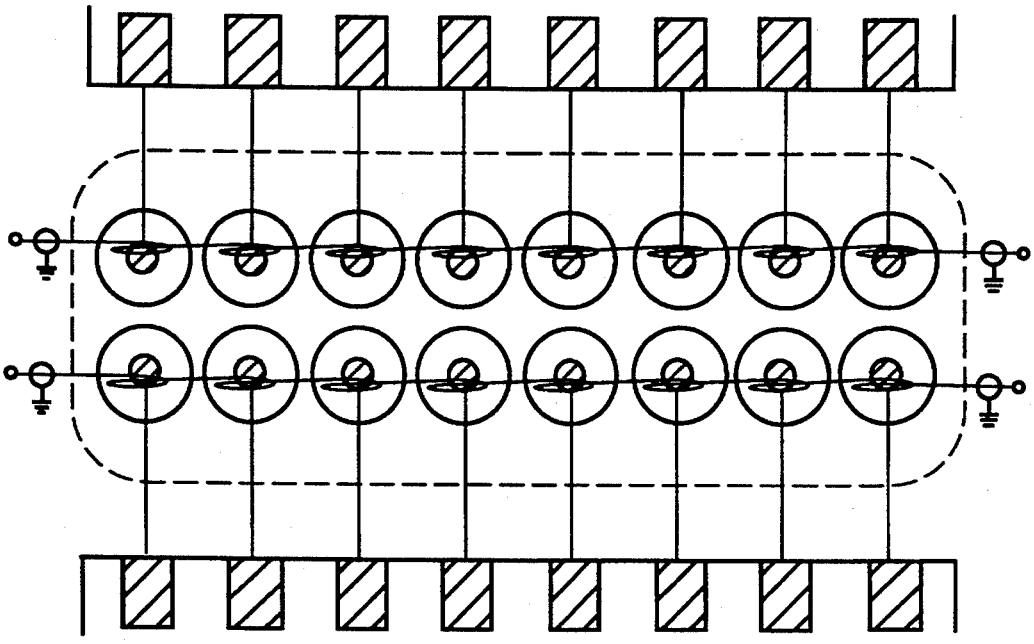
FIG. 9 is a plan view of an alternative embodiment of the invention wherein two independent 8-stage YIG notch filters are included within the same gap.

The rectangular shaped object 120 in FIG. 6 with rounded ends represents the end surface of the D.C. tuning electromagnet pole piece. Suspended above this pole piece is a block 122 of nonmagnetic material, preferably German Silver and having a plurality of cavities 124 through 133 formed therein. Preferably, these cavities are cylindrical in shape. The suspension of block 122 in the air gap between the pole pieces 120 and 120' is best seen in FIG. 8. If the block 122 accidently touches the pole piece 120 or 120', no harm will be done. Note also that FIG. 8A shows D.C. bias electromagnet tuning coils 123 and 125. These tuning coils carry the D.C. current which creates the D.C. magnetic field which is used to tune the resonant frequencies of YIG spheres 144–153. These coils 123 and 125 are driven by a conventional D.C. tuning bias driver circuit 127. This driver circuit receives the tuning signal on line 129 from the receiver circuits downstream of the YIG filter. In alternative embodiments where fixed tuning of the center frequency of the notch is acceptable, the electromagnets 123 and 125 may be replaced by permanent magnets. This true in the embodiment shown in FIG. 9 also.

The purpose of the cavities 124–133 is to shield individual resonators from one another and capacitively couple to the plurality of RF coupling loops 134 through 143 which surround and magnetically couple the RF orthogonal magnetic fields caused by the RF signals to be filtered to a plurality of YIG spheres shown as balls 144 through 153.

The block 122 can be formed of German Silver, plastic or other nonmagnetic materials. However, if the block 122 is formed of a material which is both nonmagnetic and nonconductive, at least the insides of the cavities 124–133 must be plated with a conductive material and electrically coupled to RF ground so as to provide a shunt capacitance coupled to the coupling loops 134 through 143. This shunt capacitance helps keep the characteristic impedance of the electrical transmission line between the RF signal input 160 and the RF signal output 162 down to a level which provides an acceptable impedance match to external circuitry connected to those ports. Generally speaking, other circuits to which the YIG filter is coupled have a characteristic impedance of 50 ohms. It is therefore important to attempt to maintain the characteristic impedance at the RF input 160 and the RF output 162 as close as possible to 50 ohms.

Of course, the key aspect is impedance matching, and, if some other impedance is used by the external equipment as a standard, then that impedance should be matched as closely as possible at ports 160 and 162 for best results. In both the preferred and alternative embodiments, adjustable capacitor shims may optionally be used to provide additional shunt capacitance to aid in impedance matching by compensating for the rising inductive reactance of the RF coupling loops at higher frequencies as has been done in some prior art YIG filters. In these embodiments, the shims cover the tops and bottoms of the cavities and can be deformed to change the spacing relationships between the shims and the RF coupling loops and thereby alter the shunt capacitance and the YIG filters characteristic impedance. The shim capacitor embodiments of the teachings of the invention are symbolized by the dashed shunt capacitor lines 164 and 166 in the schematic diagram of FIG. 7. Although, only one such shunt shim capacitor pair is shown is associated with YIG sphere 144, those skilled in the art will appreciate that such a shim capacitor pair or a single shim would be implemented at the site of each YIG sphere. The physical construction of the shim capacitors is well known to those skilled in the art and is not further detailed in FIGS. 6 and 8. Generally, such shim capacitors are constructed by forming a conductive "lid" over the metal cylinders in which the YIG spheres are contained and providing some facility whereby the lid may be moved closer or further away from the coupling loops such as by deformation of the metal of the shim.

The RF coupling loops 134 through 143 are full loops which completely encircle each YIG sphere. Each RF coupling loops forms a plane with a normal which is orthogonal to the direction of the lines of force of the D.C. magnetic field sustained by the D.C. electromagnetic tuning coils 123 and 125 wrapped around the pole pieces 120 and 120'. This orthogonal relationship causes precession in the dipoles formed by the electron spins which, as explained below, causes the YIG spheres to act like tuned circuits which resonate at a frequency determined by the intensity of the D.C. magnetic field.

For a given direction of the D.C. magnetic bias field, it has been found that the 220 spurious mode can be minimized and the notch depth of each individual ferrimagnetic sphere can be optimized simultaneously in the full RF coupling loop design according to the teachings of the invention if the position of the ferrimagnetic sphere relative to the plane of the RF coupling loop is adjusted for each cavity. The degree of notch improvement (>100 times) peaks at a frequency that appears to correspond to a $\frac{1}{4}$ wavelength coupling loop length. The sphere position where the deepest 110 notch and the corresponding smallest 220 spur occurs is independent of frequency.

A conventional heater comprised of blocks 170 and 172 is used to heat the YIG spheres so that typical military temperature range specifications can be met. However, these heater blocks are not necessary for some applications with less stringent temperature requirements.

The YIG spheres are suspended within the cavities 124–133 at the ends of beryllium oxide rods. Typically, the YIG spheres are glued to the ends of the rods, and the rods are anchored to the heater blocks. The rods, of which 174 and 176 are typical, pass through holes formed in the sides of the block 122 such that the ends thereof project into the cavities 124–133 in such a manner that the YIG spheres can be centered in the cavities.

In the preferred embodiment, the YIG spheres are undoped and are 0.010 inches in diameter. The spheres are centered in the cavities and the cavities 124–133 are 0.040 inches in diameter with the center-to-center spacing of the cavities set at 0.050 inches. The YIG spheres used according to the teachings of the invention are smaller than the spheres used in the prior art and the center-to-center spacing is much tighter than in the prior art. For example, the typical prior art YIG notch filter used at 18 GHz in the prior art used half loop coupling to keep the VSWR down and the spheres were placed in a circle with 0.090 inch spacing and 0.020 inch diameter spheres. Also, the air gap in the invention is small; it being typically 0.050 inches.

If it is desired to use a YIG notch filter according to the teachings of the invention below about 4 GHz, it is necessary to dope the YIG spheres to reduce their magnetization. However, this also reduces the RF coupling and may adversely affect the spurious modes. However, the use of full RF coupling loops can compensate for the loss of coupling caused by doping the spheres. Thus, spurious modes may not be adversely affected so long as the coupling compensation through use of the full RF coupling loops is adequate to replace the coupling lost because of the doping.

YIG spheres operate by precession of their magnetic dipoles under the influence of the RF magnetic field created by the RF coupling loops in response to the voltage fluctuations of the RF signals to be filtered. The magnetic dipoles are created by the spin present on the electrons in the YIG atomic structure. Without application of an external magnetic field these dipoles are randomly oriented. At a D.C. magnetic bias equivalent to about 4 GHz in undoped YIG, all the magnetic dipoles line up with the D.C. magnetic field. The RF magnetic field is applied to the spheres orthogonally to the D.C. field, and this causes the magnetic dipoles to precess at a rate of about 2.8 times the applied field in oersteds. This precession is analogous to the wobbling of a top which is spinning after a push to deflect its spin axis slightly. The frequency of this precession or wobbling of the magnetic dipoles is the YIG spheres' resonant frequency and is what makes the YIG sphere act like a tuned circuit.

When the YIG spheres are doped with a material such as gallium, the magnetic dipoles will line up at a lower magnetic field intensity equivalent to a frequency less than about 4 GHz (the lower useable frequency of undoped YIG is about 3700 MHz).

Saturation magnetization $4\pi M_S$ of YIG spheres is equal to about 1700 Gauss in pure YIG. Doping the YIG material such that $4\pi M_S$ is about 900 to 1000 Gauss allows useful notch filtering down to about 2 GHz.

Generally, the notch bandwidth, i.e., about 50 MHz in the preferred embodiment, is proportional to $4\pi M_S$, the volume of the YIG sphere and the square of the loop ratio. The loop ratio is the percentage of a full loop that is used to couple the RF magnetic field to the YIG sphere. Doping the YIG spheres to lower the value of $4\pi M_S$ will lower the notch bandwidth and may require adjustment of the RF coupling loop diameter and/or sphere volume to achieve the desired notch bandwidth.

The passband performance of a YIG filter is basically determined by the coupling structures and interloop structures used with the YIG spheres absent. The coupling loops are shown at 134 through 143 and are full loops despite the fact that the YIG notch filter depicted in FIGS. 6, 7 and 8 is intended for use up to 18 GHz. No 50-ohm, one-quarter wavelength transmission line stubs are used between YIG spheres in the preferred embodiment as is commonly found in the prior art. Instead, portions of the full coupling loops 134 through 143 are used to provide the $\frac{1}{4}$ wavelength impedance inversion function. The length of the $\frac{1}{4}$ wavelength portions of the full coupling loops is measured from center-to-center of adjacent coupling loops, i.e., from loop centerline to loop centerline. The excess coupling loop therefore does double duty in coupling the RF magnetic field created by the RF signals being filtered to the YIG spheres and simultaneously acting as a portion of the $\frac{1}{4}$ wavelength impedance inverter. Given the center-to-center spacing of the spheres, the frequency at which the wire length from the centerline of one coupling loop to the centerline of the next coupling loop is $\frac{1}{4}$ wavelength is about 12–13 GHz. This is much higher than in prior art structures using full loop coupling.

The key factors in making a design which embodies the teachings of the invention is establishing the relationships between the sphere spacing, cavity size and RF coupling loop size and other characteristics such that the spheres are spaced as closely as possible together and the "effective RF length" of the full coupling loops is $\frac{1}{4}$ wavelength at a design center frequency which is set such that the notch characteristic is optimized over the desired tuning band. For example, optimization includes establishing the above noted relationships such that the notch 3 db bandwidth at the high end of the passband is not excessively large and the notch depth is adequate at the low end of the tuning range. After establishing the above noted relationships to get the desired "effective RF length", other relationships are adjusted so as to obtain an acceptable impedance match over the entire passband. Note that the passband and the tuning range need not be exactly coincident although the tuning range must lie within the passband.

The relationships that are established to obtain the correct "effective RF length" are, in general order of importance, the physical length of the loop, the cavity size with respect to the size of the RF coupling loop as the determinant of the tightness of capacitive coupling from the RF loop to ground, the wall thickness between adjacent cavities as the determinant of the degree of RF isolation between YIG sphere resonators and the mechanical strength of the structure (this can be as little as 0.001 inches), the dielectric medium filling the cavities (this dielectric does not necessarily have to be air) as a determinant of the capacitive coupling between the loops and ground, and the diameter of the wire used in the RF coupling loops. Typically, a YIG notch filter according to the teachings of the invention is designed by selecting the RF coupling loop length, cavity and dielectric so as to establish the "effective RF length" such that, at a predetermined design center frequency in the tuning range, the "effective RF length" is $\frac{1}{4}$ wavelength. The predetermined design center frequency for the "effective RF length" is set as mentioned above to obtain acceptable notch characteristics over the desired range. After setting this "effective RF length", other relationships are adjusted to obtain a good impedance match over the desired passband. One key consideration is that the $\frac{1}{4}$ wavelength impedance inverters between YIG sphere resonators is incorporated into the full RF coupling loop structure so that the YIG spheres can be spaced as closely as possible together. The relationships that are established to obtain a good impedance match, in general order of importance, are: the number of parallel conductors in the RF coupling loop (this is usually two wires spaced very close together), the wire diameter, and the shape of the cavity as a determinant of the proximity of the cavity walls to the RF coupling loop wire and the capacitive coupling of this wire to ground throughout its length.

It is also possible that ferrimagnetic materials other than yttrium-iron-garnet (YIG) can be used. As the term is used herein, "ferrimagnetic" means only materials that exhibit magnetic properties like those of YIG spheres and which can be successfully used to fabricate a notch filter. For example, lithium ferrite, doped YIG, nickel-zinc-ferrite, etc. can all be used.

The teachings of the invention contemplate that the cavities are spaced closely together to obtain the benefit of smaller magnet size, better uniformity of flux density affecting all spheres, lower weight, smaller physical size and more spheres within any given magnet gap area. However, it is not critical to the invention that the spheres be placed absolutely as close together as possible since the above noted benefits can also be obtained in embodiments where the cavities are not spaced as closely together as is physically possible. Generally, the teachings of the invention contemplate spacing the cavities closely together and incorporating the majority of the required $\frac{1}{4}$ wavelength impedance inverter into the physical length of the full RF coupling loops. This minimizes the required length of the interloop coupling wires referred to in the claims as wire leads, thereby rendering it possible to make a more compact structure without substantial loss in performance. However, it is not critical to the invention to absolutely minimize the length of the interloop wire leads, and in some embodiments, the wire leads may be somewhat longer and the physical length of the RF coupling leads somewhat shorter, so long as the combined physical length and the other electrical factors identified above combine to create an effective RF length which is $\frac{1}{4}$ wavelength at the design center frequency of 8 GHz or above. The term "majority" as it is used in the claims means that the physical length of the wire leads should be substantially less than $\frac{1}{4}$ wavelength at the design center frequency at or above 8 GHz, and most (typically greater than 67%) of the effective RF length should be attributable to the physical length of the RF coupling loop. In the preferred embodiment, the RF coupling loop size is maximized and the wire lead physical length is minimized such that about $\frac{3}{4}$ of the total physical length of wire which causes the effective RF length to be $\frac{1}{4}$ wavelength at the design center frequency is within the full RF coupling loop and the balance is attributable to the interloop connection wire leads.

It is also within the teachings of the invention to make each RF coupling loop with multiple turns of wire, although such an embodiment would only be useful at low frequencies since the impedance of the RF coupling loops at high frequencies such as 18 GHz would be so high as to preclude an effective impedance match with 50 ohm input and output circuits coupled to the filter. Of course if a standard impedance of higher that 50 ohms were used for interfacing, the multiple turn RF coupling loops might also be useful at high frequencies. Such multi-turn RF coupling loops would by their nature embody substantially all of the $\frac{1}{4}$ wavelength impedance inverter where the cavities are spaced very closely together with minimal length in the interloop wire leads.

In the preferred embodiment, twin wires of 0.006–0.007 inch diameter were found to provide the best passband performance. Although having the two wires touch provides fairly good passband performance, separating the wires improves the passband performance. The two wires are soldered together between each sphere to substantially improve the notch performance. These solder joints are shown at 180 through 187. The twin wires are still spread apart in the coupling loop portions between the solder joints in the preferred embodiment, although in other embodiments, they may be touching. Generally, it is preferred to spread the wires by at least one diameter, although in other embodiments, other spreading distances can be used. It has been found that these solder joints somehow eliminate distortions in the notch performance by a mechanism that is not currently understood. In some embodiments where certain distortions of the notch performance are tolerable, elimination of the solder joints is within the teachings of the invention. The wires should be insulated to guard against shod circuits of the RF signals travelling therein to the ground plane, but other arrangements such as insulating the inside surfaces of the cavities and the top surface of the block 122 are also within the teachings of the invention.

Given the 0.050 inch spacing and the 0.040 inch diameter cavities, it is apparent that the wall thickness of the wall portions of the block between adjacent cavities are only 0.010 inches thick. It will be apparent to those skilled in the art that the coupling loops are also placed much closer to the cavity walls according to the teachings of the invention than was done in the prior art. This helps keep the characteristic impedance low even though full loops are being used at 18 GHz contrary to the conventional wisdom that full loop coupling cannot be used at the high end of the 2–18 GHz passband because of the difficulties in keeping the characteristic impedance close enough to 50 ohms to provide acceptable impedance matching at the input and output. The spacing of the coupling loop wires should be at least one diameter, but other spacing or no spacing at all can also be used in other embodiments.

The two lines of YIG spheres and their associated coupling loops each couple to solder joints 200 and 202 at the ends of a 50 ohm transmission line 204. The transmission line 204 is typically microstrip but other types of transmission lines such as a suspended wire in a cavity may be used in alternative embodiments. In some alternative embodiments, the transmission line 204 may be some other higher impedance line which has an input impedance designed to match the output impedance of the first line of spheres looking from node 200 toward the RF input port 160 and having an output impedance matching the input impedance of the second line of spheres at node 202 looking toward the RF output node 162. Ideally, both of the impedances at nodes 200 and 202 looking toward the RF ports will be 50 ohms and the transmission line segment 204 will also be 50 ohms.

If operation at frequencies higher than 18 GHz is desired or if for any reason the impedances at nodes 200 and 202 cannot be brought down to 50 ohms, known integrated nonlinear transmission line impedance transformers can be used at locations 206 and 208 to transform the impedance from whatever impedance characterizes the coupling loop structure at the frequency of interest and an industry standard 50 ohms at the RF ports 160 or 162 (or whatever other impedance is desired at these RF ports).

Note that a more or less rectangular shaped pole piece is used because of the linear arrangement of the YIG spheres as opposed to the circular arrangements often used in the prior art. In both the prior art and the invention, it is important to subject all the YIG spheres to about the same magnetic flux density. The use of the linear arrays of cavities slightly complicates this consideration, but spacing the lines of spheres close together and parallel such that a small area is consumed by the sphere array allows a substantially equal magnetic tuning flux to be applied to each sphere. In some embodiments, shaping of the magnetic flux density to further improve the flux density uniformity across the array is used.

Figure 10:
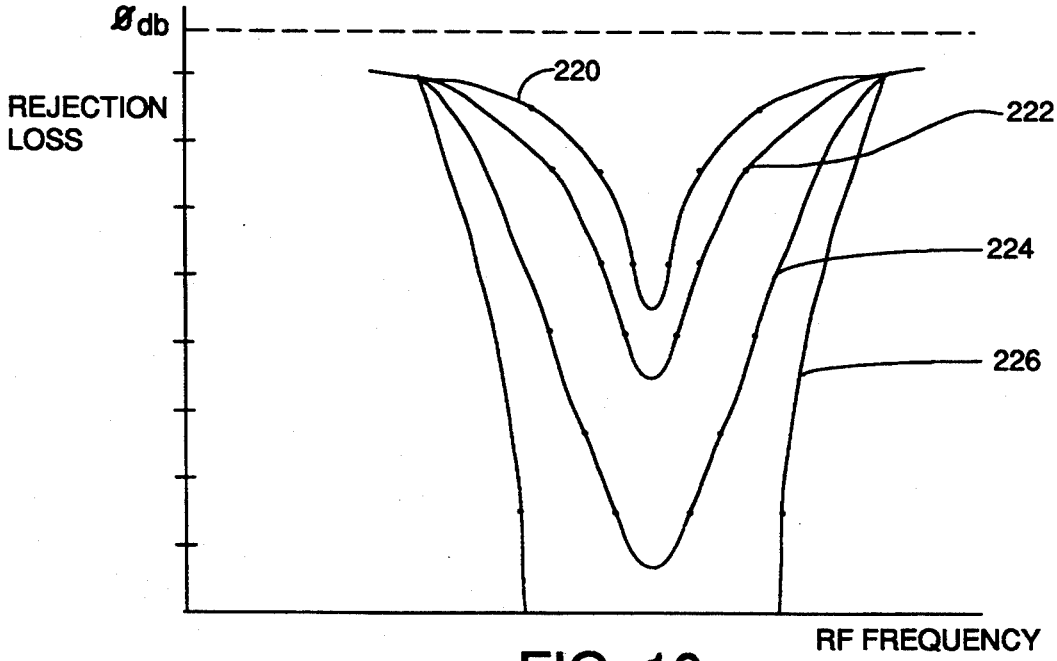
FIG. 10 is graph of the rejection loss versus frequency for various YIG tuned band reject filters according to the teachings of the invention having different numbers of YIG spheres.

Because the area required to contain 10 spheres in two lines of 5 is less than the area required to contain 10 spheres arranged in a circle, the air gap is smaller in area. In fact, the air gap area required to encompass 10 spheres arranged linearly according to the teachings of the invention is actually less than the air gap area required to encompass 7 YIG spheres arranged in a circle in prior art designs. This allows either for the addition of more YIG spheres thereby improving the notch characteristics or for faster switching speeds or both. Use of more spheres makes the notch deeper such that a useable level of rejection can still be obtained at the extreme ends of the passband despite the notch shape distortions caused by the fact that the $\frac{1}{4}$ wavelength impedance inverters are no longer exactly $\frac{1}{4}$ wavelength at the extreme ends of the passband. FIG. 10 illustrates the effect of adding more YIG spheres at the frequency where the "effective RF length" is $\frac{1}{4}$ wavelength. FIG. 10 represents a diagram of the notch attenuation characteristics of YIG filters having varying numbers of stages. Curve 220 represents the notch characteristics of a 2-sphere YIG band reject filter. Curve 222 represents the notch characteristics of a 4-sphere filter. Note how the 4-sphere notch is deeper at its center frequency and has a wider notch bandwidth. Curve 224 represents the notch characteristic of an 8-sphere filter. It is deeper at its center frequency and wider again in its notch bandwidth than the 4-sphere notch. Finally, curve 226 represents the notch of a 16-sphere filter. Note that it is wider again at its notch bandwidth than the 8-sphere notch.

Smaller air gaps have the advantages of requiring less power to create a given intensity magnetic field in the gap, easier creation of a uniform magnetic intensity in the gap, and smaller overall physical size for the magnet. Since power consumption and space requirements are tight in some applications, these are significant advantages. The ability to add more YIG spheres without increasing the gap size provides the ability to create a single YIG notch filter which can cover the entire passband from 2 to 18 GHz in a single structure although doping of the YIG spheres may be necessary to achieve adequate performance below 4 GHz. More spheres provide the possibility of covering the entire passband in a single filter because, although the filter design will be optimized for the high end of the passband, useable performance will still result in the low end of the band. The smaller air gap also results because smaller YIG spheres are used which means smaller cavities and a thinner block can be used. This means the distance between the pole pieces can be reduced which carries with it the advantages stated above for smaller air gap areas. Because of the more compact structure, it is possible to create multiple separate YIG filters in the same air gap which track each in tuning of the notch center frequency, because all filters experience the same D.C. tuning bias magnetic flux intensity. For example, two separate 8 sphere YIG filters can be placed side by side in the same air gap such as is symbolically shown in FIG. 9. This concept could find utility in a two channel or dual receiver application where each receiver needs simultaneous tuning of its own YIG notch filter such that the notches of each receiver's filter track each other with regard to changes in their center frequencies.

The smaller air gap results in an overall magnet size which is small enough to build a 10-sphere YIG filter in a 1.4 inch cube. This small size allows a number of YIG notch filters to be placed in series in applications where size and weight are important.

Faster tuning speeds also result from the smaller air gap because less total magnetic flux is present to change. This allows interfering signals to be removed faster by more quickly tuning the center frequency of the band reject notch to match the center frequency of the interfering signal.

Another benefit of the more compact structure and smaller pole pieces is that for a given size of YIG filter outside dimensions, less power is needed to tune the notch to any particular frequency in the passband because more tuning coil turns may be used.

Another benefit of the YIG notch filter according to the teachings of the invention is reduced insertion loss. The coupling loop/cavity combination has an air dielectric and the 50 ohm stripline or microstrip $\frac{1}{4}$ wavelength impedance inverters between the coupling loops have been eliminated. Stripline and microstrip $\frac{1}{4}$ wavelength impedance inverters are more lousy than the coupling structure according to the teachings of the invention because they do not use air dielectric. The lower insertion loss allows more stages to be used and allows cascading of several individual filters without adverse consequences.

The construction according to the teachings of the invention is essentially a continuous pair of wires which are hand formed in the cavities. Even with this hand forming, the structure of the invention is easier to build and match than prior art structures using stripline or microstrip impedance inverters between stages. With suitable tooling to mechanize the fabrication, the cost could be dramatically reduced.

The smaller air gap area also allows new design concepts to be tried such as a YIG notch filter and a YIG bandpass filter in the same air gap. Other schemes are also possible such as diode switching to change the number of YIG stages or to change the transmission line length at interconnection points.

The use of full loop coupling also reduces the sensitivity of the filter of the invention to manufacturing errors in placement of the YIG spheres as explained earlier herein.

Also, non-reciprocal techniques may be employed to further reduce spurious responses. Nonreciprocal coupling means that band reject notch has a different rejection loss characteristic versus frequency for one orientation of the B tuning field than for the opposite orientation. The same phenomenon is observed if the input and output is exchanged or if the YIG spheres are moved from a position outside the plane of the loop on one side thereof to a position outside the plane of the loop on the other side thereof.

Nonreciprocal coupling is a useful tool in YIG design, especially in multisphere YIG filters because it has two desirable properties. First, at low frequencies around 2 GHz where YIG filters normally do not have high Q, nonreciprocal coupling causes a huge rise in apparent Q. This makes the notch depth deeper for better filter performance. The second useful property of nonreciprocal coupling is that it can be used to cause spurious (2,2,0) Walker modes to disappear or be substantially reduced. Nonreciprocal coupling is achieved according to the teachings of the invention by placing the YIG spheres outside the plane of the RF coupling loops and making the full loop RF coupling loops have an effective RF electrical length of one-quarter wavelength from the centerline of each RF coupling loop to the centerline of the next adjacent RF coupling loop at a design center frequency above 8 GHz, and preferably about 12–13 GHz for a tuning range or passband of from 2–18 GHz. Generally, the design center frequency is approximately midway through the tuning range, but it is selected so as to optimize the notch characteristics. The physical characteristics of the nonreciprocal filter such as the length and diameter of the RF loops, the cavity dimensions relative to the RF coupling loop size, the RF coupling loop wire size and spacing between the wires, the size and spacing of the ferrimagnetic spheres are all selected so as to optimize filter performance. This generally occurs when the effective electrical length from one RF coupling loop centerline to the centerline of the next adjacent RF coupling loop is one-quarter wavelength at approximately 12–13 GHz and the position of each sphere relative to each RF coupling loop is set to achieve nonreciprocal coupling. Each YIG sphere has its position adjusted individually relative to the plane of the RF coupling loop via adjusting rods of which rod 310 is typical so that the 110 mode band reject notch is maximized and the 220 spurious modes disappear or are minimized. If this cannot be achieved, the sense of the B field is reversed, or the input and output are exchanged or the spheres are moved to the other side of the loops.

Each adjusting rod is thermally coupled to and supported by a heater block in the preferred embodiment of which heater block 312 is typical. The heater blocks keep the YIG spheres at elevated temperatures to meet military specifications for performance and may not be needed in some embodiments.

Figure 11:
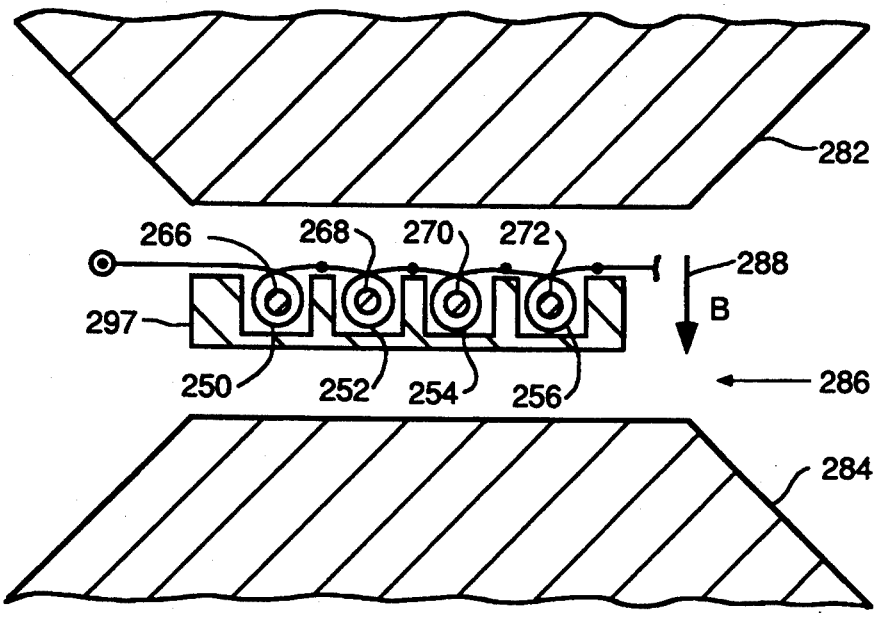
FIG. 11 is a side (elevation in section) view of a fixed tuned YIG band reject filter according to the teachings of the invention using full coupling loops that have an effective electrical length of one-quarter wavelength and using permanent magnets to establish the tuning bias.
Figure 12:
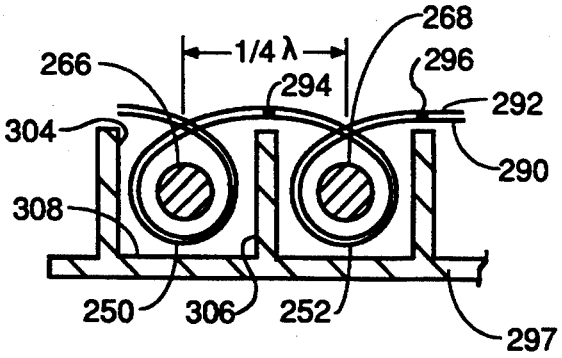
FIG. 12 is a more detailed view of the RF coupling loops used in the preferred embodiment of the class of filters symbolized by FIG. 11 where two small wires, separated by approximately one diameter are used for each RF coupling loop. The wires are soldered together between spheres.
Figure 13:
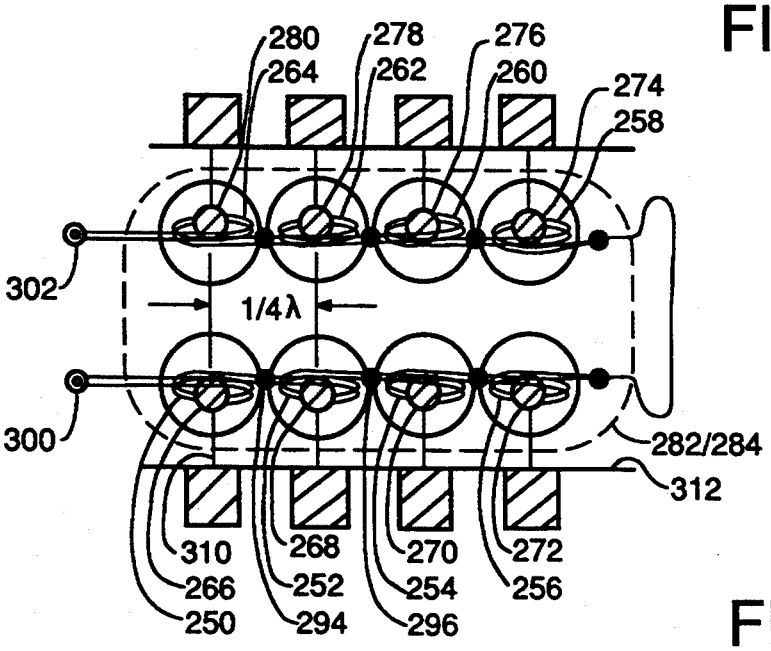
FIG. 13 is a plan view of the preferred embodiment of the a YIG band reject filter using full coupling loops with an effective RF length of $\frac{1}{4}$ wavelength from loop centerline to loop centerline at a frequency above 8 GHz with the ferrimagnetic spheres offset from the planes of the RF loops to achieve nonreciprocal coupling.

Referring to FIGS. 11–13, there is shown the preferred embodiment of a multisphere YIG band reject filter using nonreciprocal coupling. FIG. 11 shows in elevation a sectional view through the YIG spheres. FIG. 12 is an expanded sectional view through two of the YIG spheres of FIG. 11 showing the use of two wires in the RF coupling loops more clearly. FIG. 13 is a plan view of the YIG filter of FIG. 11 showing the eight individual cavities with their RF coupling loops therein and showing how the YIG spheres are offset from the plane of the loop.

In FIG. 11, a magnet pole piece comprised of two poles 282 and 284 separated by flux gap 286 provides the magnetic field which tunes the center frequency of the band reject notch. The magnetic field in flux gap 286, or B field as it is sometimes called, has the general orientation shown by arrow 288, but the direction may be reversed depending upon which orientation is needed to generate the nonreciprocal coupling. The magnetic field may be generated either by a permanent magnet material or by an electromagnet. Use of a permanent magnet will cause the center frequency of the notch to be fixed, while use of an electromagnet allows the center frequency of the notch to be varied by altering the intensity of the B field in the flux gap 286. The outline of the pole pieces and flux gap is shown at 282/284 in FIG. 13.

As shown in FIG. 12, each RF coupling loop is formed using two wires in the preferred embodiment. Use of two wires causes less spurious response especially where the wires are separated by at least the diameter of one of the wires. The two wires are shown at 290 and 292 in FIG. 12. The dots 294 and 296 represent solder connections between the wires. It has been found that performance improves when the twin wires are soldered together periodically. These solder joints are symbolized by the dots in FIG. 13 of which dots 294 and 296 are typical. In other embodiments single wires, more than two wires, or straps may be used.

As in the case of the other embodiments disclosed herein, each YIG sphere and its associated RF coupling loop is contained within a cavity in a block of nonmagnetic material such as German Silver. The walls and floor of the cavity that contains the YIG sphere 266 are shown at 304, 306 and 308 in FIG. 12. The block of nonmagnetic material 297 is conductive and serves to electrically isolate the spheres so that the RF fields generated by one RF coupling loop do not couple to adjacent YIG spheres. The conductive walls of the cavity also capacitively couple to the RF coupling loops and effect the impedance of the transmission line from input 300 to output 302. The cavities are symbolized in FIG. 13 by the circles that surround each YIG sphere and RF coupling loop.

One of the biggest problem in the YIG filter art area is how to manage the (2,2,0) Walker mode spurious responses in ferrimagnetic band reject filters so as to not adversely affect the performance of the YIG filter. In the prior art, the conventional wisdom as to how to get rid of the (2,2,0) Walker mode in a band reject filter was to have each sphere have a different gauss level to prevent the frequencies of the (2,2,0) Walker modes from coinciding and/or to sand each sphere to lower the Q of the material to decrease the coupling to the sphere. This prevented the (2,2,0) Walker modes from "stacking".

Figure 14:
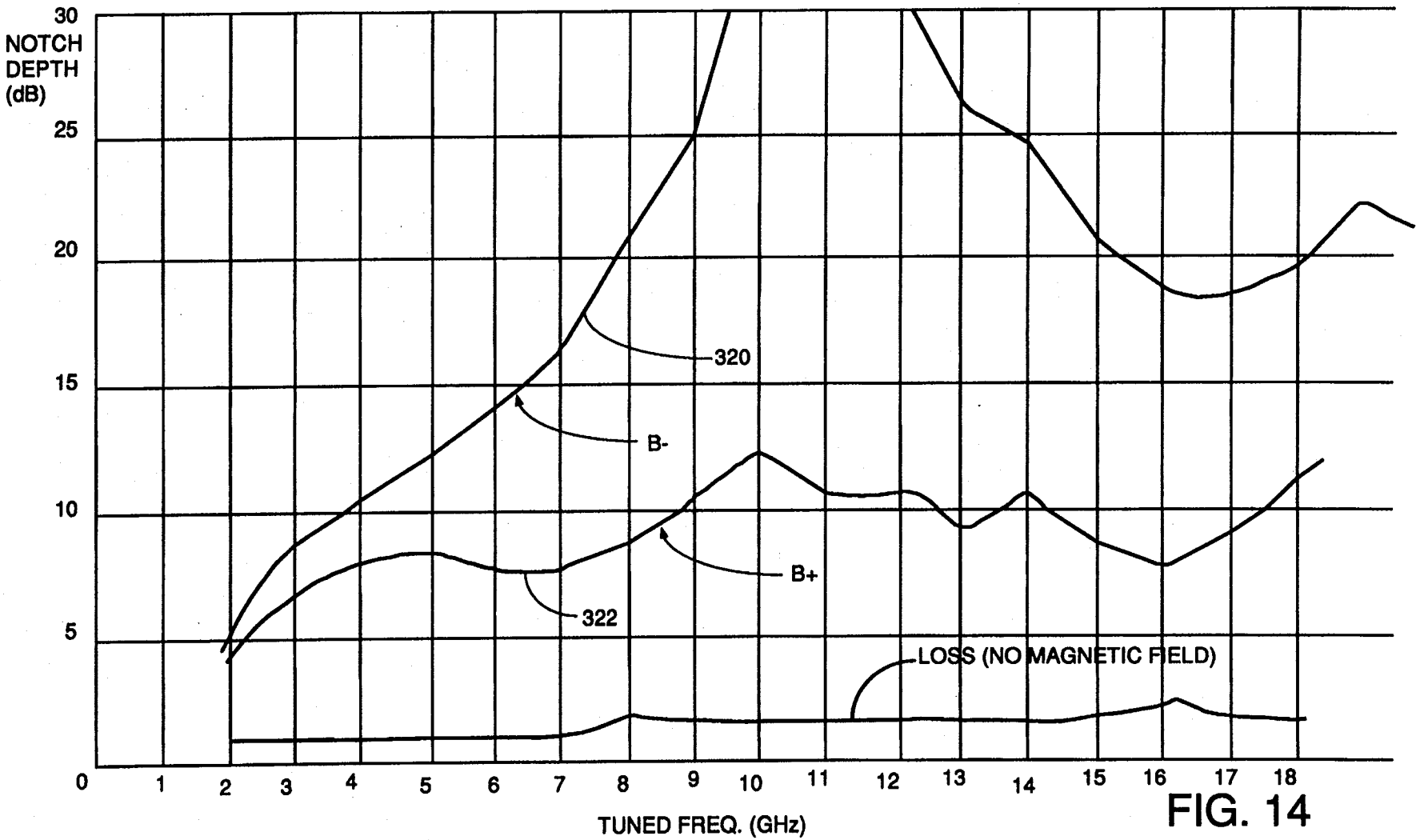
FIG. 14 is a graph of a typical nonreciprocal band reject notch performance according to the teachings of the invention showing how the band reject notch peaks for one orientation of the magnetic field and not for the other orientation.

During the course of developing the invention, a full-loop, band-reject filter with a tuning range including frequencies above 8 GHz was built. It was observed during testing of this structure that by adjusting the positions of the spheres relative to the positions of the RF coupling loops, it was possible to minimize the adverse effects of the (2,2,0) Walker modes. After making this observation, it was noted during testing of a single sphere to measure the Q thereof that notch depth had a nonreciprocal coupling property as shown in FIG. 14. It was further noted, that the maximum notch depth occurred at a frequency where the RF coupling loop length was approximately one-quarter wavelength. It was also noted that altering the position of the sphere relative to the position of the loop could maximize the separation, i.e., maximize the nonreciprocity, of the curves 320 and 322 in FIG. 14 thereby optimizing the notch depth of curve 320. Finally, it was noted that when the notch depth of the curve 320 was optimized (maximum rejection), the adverse effects of the (2,2,0) Walker modes appeared to be minimized. This is a very important property of this structure since management of the adverse effects of the (2,2,0) Walker mode spurious responses has always been a significant problem in YIG band reject filter design, especially at the high end of the tuning range. This problem becomes even more difficult when the tuning range includes frequencies above 8 GHz, because the coupling to the (2,2,0) Walker modes increases with increasing frequency thereby exacerbating the adverse effects of the 220 spurious response notches in the passband.

In FIG. 14, the rejection loss or notch depth in db is plotted on the vertical axis, and the frequency in GHz is plotted on the horizontal axis. The curve 320 represents the notch depth versus frequency of one YIG sphere for one orientation of the B field, i.e., one direction of magnetic flux arrow 288 in FIG. 11, and the curve 322 represents the notch depth versus frequency for the same sphere and for the same position of the sphere relative to the position of the RF coupling loop for the opposite orientation of the B field for the band reject filter structure shown in FIGS. 11–13, both curves characterizing a YIG band reject filter structure where the sphere positions relative to the positions of the RF coupling loops is selected to optimize the nonreciprocity. Each YIG sphere has a similar notch depth versus frequency characteristic. These two notch depth curves plainly show that the structure of FIGS. 11–13 enjoys nonreciprocal coupling, because the YIG sphere cuts a notch in the passband from 2–18 GHz for one orientation of the B field and does not cut a notch in the passband for the other B field orientation. The same nonreciprocal behavior can also be obtained by reversing the direction of signal propagation.

In FIG. 14, the reader will note that the deepest notch depth occurs somewhere between 10 and 12 GHz. This is the frequency for which the length of the full RF coupling loops and all the other factors which combine to effect the effective RF electrical length, render the full coupling loops approximately one-quarter wavelength from loop centerline to loop center line i.e., the phase shift from loop centerline to the adjacent loop centerline is 90 degrees. Although it is not clear what causes the nonreciprocal coupling, it is known for the full loop, one-quarter wavelength structure shown in FIGS. 11–13, that nonreciprocal coupling occurs.

In the prior art exemplified by U.S. Pat. No. 4,179,674 (hereafter the '674 patent), nonreciprocal coupling was taught. However, in that patent full loop RF coupling was not taught, and circular polarization was suggested as being responsible for raising the apparent Q and for the nonreciprocal coupling. In the '674 patent, the circular polarization was taught as being achieved by offsetting the YIG spheres from the plane of the RF coupling loops and coupling a capacitor to the RF loops to provide electrical phase shift.

The RF coupling loops taught in the '674 patent were much shorter in length than the full coupling loops according to the teachings of the invention. The coupling loop lengths taught in the '674 patent were all so shod that the nonreciprocal properties of one-quarter wavelength loops were never before noticed for YIG filters having passbands including the higher frequencies from 8–18 GHz. It was also taught in the '674 patent that to get the necessary 90 degree electrical phase shift for circular polarization, it was necessary to couple a capacitor to the line.

Flying in the face of this conventional wisdom, the inventors proved that nonreciprocal coupling could be achieved without the capacitor and that full loops could be used at high frequencies from 8–18 GHz with good performance and a YIG filter input impedance that was close enough to 50 ohms to have acceptable VSWR.

The use of full loop, one-quarter wavelength RF coupling loops and YIG spheres offset from the planes of their respective RF coupling loops has the advantage of increasing the apparent Q of the band reject filter. However, a more significant advantage occurs at high frequencies around 18 GHz, where YIG spheres have sufficient Q, but in multisphere band reject filters the (2,2,0) Walker mode spurs from each sphere tend to line up and cut a deep notch in the passband where no notch is desired. Sanding the spheres to reduce the 220 mode spurious responses however also decreases the Q of the desired 110 mode notch thereby decreasing the notch depth and increasing the bandwidth, both of which are undesirable results. If each sphere is doped to have a different gauss level, the separation between the 110 mode and the (2,2,0) Walker mode for each sphere will be different. Thus, the (2,2,0) Walker modes will not line up when the (1,1,0) Walker modes (also referred to herein as the 110 modes) are lined up. This was very inconvenient. The nonreciprocal coupling provided according to the teachings of the invention allows the (2,2,0) Walker modes to be reduced or eliminated without the need to dope each YIG sphere to have a different gauss level or to sand the spheres.

The full loop concept can also be used to advantage for broad bandwidth ferrimagnetic passband filters. Specifically, broad bandwidth passband filters are built using tight coupling between the RF coupling loops and the ferrimagnetic spheres. This tight coupling, in a bandpass filter, not only causes the bandwidth of the desired 110 mode passband to increase, it also causes the center frequency thereof to rise toward the center frequency of the (2,2,0) Walker mode notch. This phenomenon is called pulling. If it becomes significant enough, the 110 mode passband can be pulled into the (2,2,0) Walker mode notch thereby distorting the shape of the 110 passband and adversely affecting its performance. In full loop ferrimagnetic passband filters with a desired bandwidth which is wide relative to the spacing between the 110 mode and the (2,2,0) Walker mode (which is dependent upon the ferrimagnetic sphere gauss level), the pulling phenomenon can be so great as to cause the (2,2,0) Walker mode notches for the input and output loops to reside in the desired 110 mode passband thereby cutting undesired notches therein. The nonreciprocal coupling property of the full loop passband filter according to the teachings of the invention can be used advantageously to remove these (2,2,0) Walker mode notches from the 110 mode passband.

Figure 15:
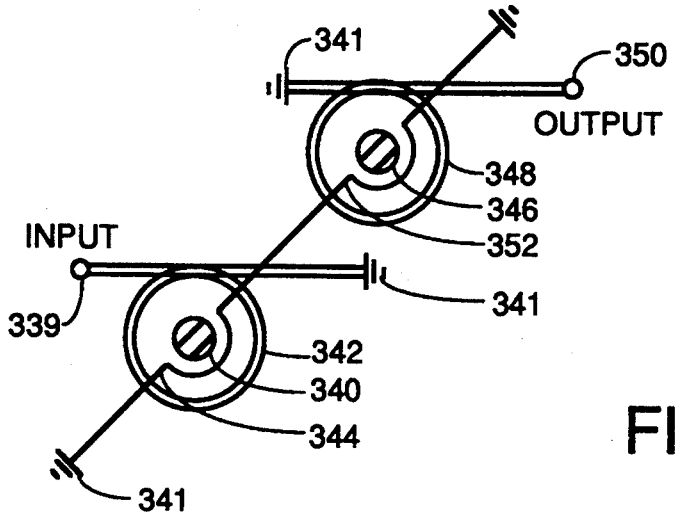
FIG. 15 is a symbolic diagram of the bandpass filter using full RF coupling loops at the input and output and achieving nonreciprocal properties.

Referring to FIG. 15, the details of one embodiment of a full loop, broad bandwidth passband filter having a passband of about 500 Mhz and a tuning range from about 6–18 GHz are shown schematically. In FIG. 15, the details of the cavities, and the tuning magnet and air gap are omitted, but will be apparent to those skilled in the art. A two stage passband filter is shown. A first ferrimagnetic sphere 340 acts as the input stage. The sphere 340 is resident inside a cavity (not shown) in a nonmagnetic block (also not shown), and this block is in the air gap of a tuning magnet (not shown) which provides a tuning magnetic field in which the ferrimagnetic sphere resides. The B field flux intensity created by this tuning magnet establishes the center frequency of the passband. The B field intensity may be fixed in magnitude such as by use of permanent magnets or it may be variable such as by use of electromagnets.

A full RF loop 342 is coupled to the first ferrimagnetic sphere 340 as in the case of the band reject filter and is coupled to an RF input 339 and ground 341 except that the position of the ferrimagnetic sphere is outside the plane of the RF coupling loop 342 as in the case of the band reject filter. In the preferred embodiment, the RF coupling loop 342 is comprised of two parallel wires separated by the diameter of one wire. The RF coupling loop 342 is coupled to an RF input to receive the signal to be filtered and couples an RF magnetic field to the YIG sphere 340. The length of the RF coupling loop 342, the size of the cavity (not shown), the diameter of the wires used to form the RF loop and the separation of the wires, and the dielectric filling the cavity are all established in proper relationship to each other such that the "effective RF length" of the RF coupling loop 342 is $\frac{1}{4}$ wavelength at some frequency above 8 GHz, preferably 12–13 GHz for a tuning range from 6–18 GHz.

A half loop coupler 344 passes either over or under the ferrimagnetic sphere and defines a plane which is substantially orthogonal to the plane of the RF coupling loop 342. The purpose of this orthogonality is to prevent substantial RF energy from being directly coupled from input loop 342 to the half loop coupler 344. Instead, energy absorbed by the ferrimagnetic sphere 340 is coupled into the half loop coupler 344 for coupling to a second stage ferrimagnetic sphere 346. The half loop coupler can pass directly over or under the ferrimagnetic sphere as there is no particular need for the spheres 340 and 346 coupled to the half loop coupler 344 to be offset from the plane of the half coupling loop. It is preferred that the half loop coupler be orthogonal to the full loop 342, but it is not absolutely critical and some angle less than or greater than 90 degrees can be used in other embodiments.

The half loop coupler is coupled to ground 341 at one end and traverses the space between the input stage sphere 340 and a second ferrimagnetic sphere 346 serving as the output stage.

The output stage sphere is coupled to a full RF loop 348 which is coupled to an RF output 350 and to ground 341. The full RF loop 348 is also made from twin, parallel wires separated by one wire diameter in the preferred embodiment, and has a length which is related to the size of the cavity in which the second sphere 346 resides relative to the size of the RF loop, i.e., the degree of tightness of coupling (cavity not shown), the size and separation of its wires, and the dielectric constant of the dielectric filling the cavity so as to have an "effective RF length" of ¼ wavelength at a frequency greater than 8 GHz, preferably 12–13 GHz for a 6–18 GHz passband and preferably the same frequency at which the input stage RF coupling loop 342 has an effective length of ¼ wavelength.

The half loop coupler 344 includes another half loop 352 which couples RF energy from the ferrimagnetic sphere 340 to the ferrimagnetic sphere 346. The half loop 352 defines a plane which is preferably substantially orthogonal to the plane defined by the full RF loop 348. Both the input stage ferrimagnetic sphere 340 and the output stage ferrimagnetic sphere 346 are positioned outside the planes of their respective full RF loops with their positions selected so as to minimize or eliminate the (2,2,0) Walker modes.

Figure 16:
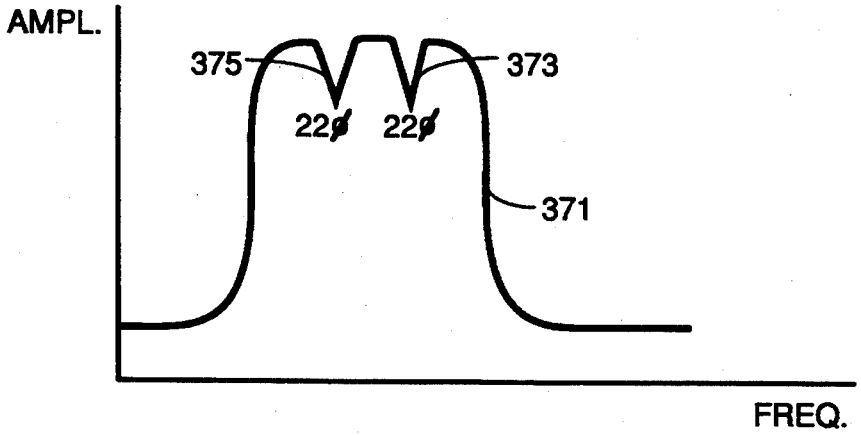
FIG. 16 is a graph of the bandpass shape of a broad bandwidth passband filter where nonreciprocity is not used to eliminate the (2,2,0) Walker mode notches which have been pulled into the bandpass band.

FIG. 16 shows the type of filter characteristic which was found when a full-loop, broad-bandwidth, bandpass filter for use in the range from 6–18 GHz was first built. The vertical axis represents the signal strength at the output of the filter for a signals of various frequencies which have attempted to pass through the filter. The horizontal axis represents frequency. The curve 371 represents the filter passband characteristic. The passband characteristic shows two undesirable 220 spurious mode notches right in the middle of the passband. This problem usually only arises when attempts are made to create a wide bandwidth passband relative to the gauss level, i.e., the determinant of the spacing between the 110 and (2,2,0) Walker modes. To get a wide bandwidth, it is necessary to have tight coupling between the RF coupling loop and the sphere, especially at the input and output stages. But this tight coupling has the adverse effect of pulling the 110 mode passband into the (2,2,0) Walker mode notches thereby distorting the passband shape. The spurious mode notches 373 and 375 are the result of (2,2,0) Walker modes being excited by heavy RF coupling to the spheres by virtue of the full RF loops.

Figure 17:
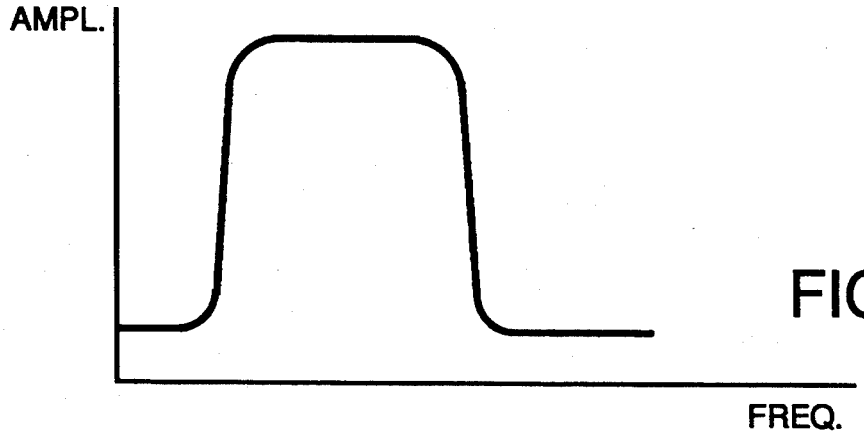
FIG. 17 is a graph of the bandpass shape of a broad bandwidth passband filter where nonreciprocity is used to eliminate the (2,2,0) Walker mode notches which have been pulled into the bandpass band.

The invention was realized when the spurious notches were accidently found to disappear during lab testing when the sense of the B field in a full loop, wide bandwidth passband filter was reversed. Initially it was thought that the spurious modes had disappeared because the spheres had been exactly centered in the RF loops which was one way used in the prior art to reduce or eliminate the effects spurious modes. However, the inventors discovered that, in fact, the spheres were not centered in their RF loops, and in fact had been moved out of the plane of the RF loops. It was then discovered, quite by accident, that the real reason that the spurious modes disappeared was because the RF loops were long enough to have an effective RF electrical length of ¼ wavelength at about 12–13 GHz and that this fact combined with the fact that the YIG spheres were offset relative to the planes of the RF loops so as to cause nonreciprocal properties. Although it is not exactly understood why the (2,2,0) Walker mode spurs occur in the passband in such a wide bandwidth passband filter for one orientation of the B field, but not for the other, it is thought to be caused by the nonreciprocal nature of the coupling and circular polarization. Regardless of what causes the effect, it is known that when a broad bandwidth passband filter is built with the full loop structure defined above, the spurious modes may appear in the passband, but they can be easily removed by reversing the sense of the B field or switching the side of the RF loops on which the YIG spheres reside. The resulting filter passband characteristic is as shown in FIG. 17.

Figure 18A:
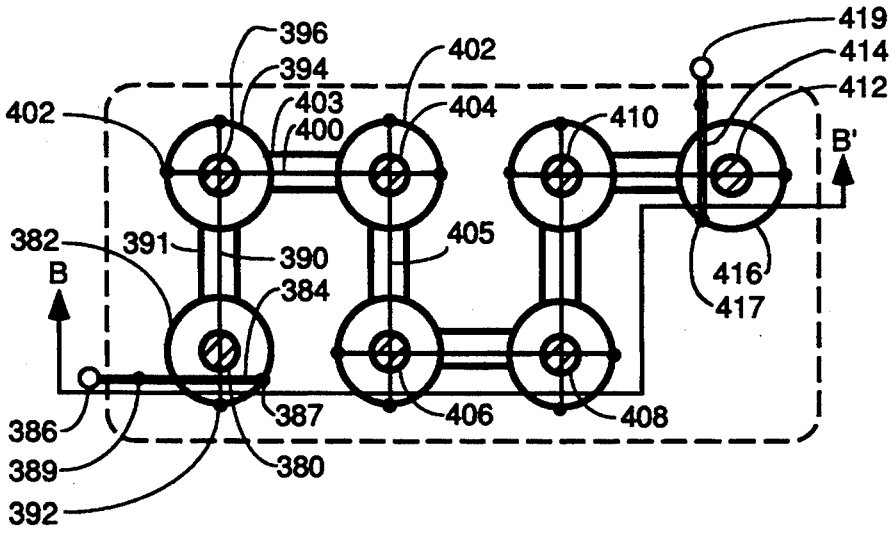
FIG. 18A is a plan view of a bandpass filter using the nonreciprocal structure according to the teachings of the invention.
Figure 18B:
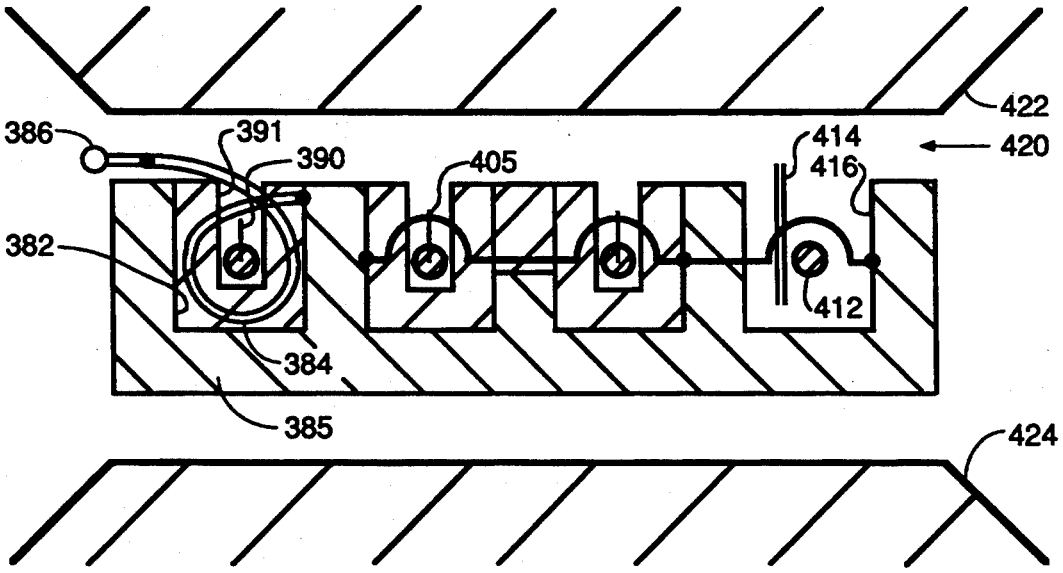
FIG. 18B is an elevation sectional view of the bandpass filter of FIG. 18A.

In alternative embodiments, the structure shown in FIG. 15 can be extended to multiple stages. In such an embodiment, the input and output stages are as shown in FIG. 15 but multiple stages are used between the input and output stages. FIG. 18A shows such an embodiment in plan view, and FIG. 18B shows such an embodiment in elevation taken along section line B—B' in FIG. 18A. Referring jointly to FIGS. 18A and 18B, an input stage ferrimagnetic sphere 380 is supported in a cavity 382 of a nonmagnetic block 385 by a beryllium oxide rod (not shown) thermally coupling the sphere with a heater block. A full loop RF coupler 384 made of two, small diameter wires separated by the diameter of one of the wires encircles the sphere and has one end coupled to an RF input 386 and the other end grounded via a solder joint to the cavity walls. As best seen in FIG. 18A, the sphere 380 is not in the plane of the full RF loop 384, but displaced somewhat therefrom. The position of the ferrimagnetic sphere 380 relative to the plane of the loop 384 is adjusted to minimize the 220 spurious modes. If ¼ wavelength full loops are used at the input and output stages, and the spheres are located outside the planes of the loops, nonreciprocal coupling can be achieved; In such a case the (2,2,0) Walker modes can be completely eliminated from the passband by reversing the sense of the B field if the (2,2,0) Walker mode spurs appear in the tunable passband. The full RF loop 364 couples the RF input 386 to a ground connection 387. A solder connection 389 connecting the two wires improves performance of the loop as is well known in the art.

A half loop coupler 390 comprising a single wire half loop passing directly over or under the ferrimagnetic sphere 380 has one end connected to ground via a solder joint to the wall of cavity 382 at 392. In some embodiments, the half loop couplers need not pass directly over or under the ferrimagnetic sphere but may be displaced from the centerline of the sphere. After passing over or under the sphere, the half loop coupler enters a passage 391 cut into the metal of the block in which the cavities are formed. Fundamentally, each cavity is coupled to the cavity of an adjacent sphere to which the half loop coupler is directed by a passageway through which the half loop coupler passes. Thus, cavities 382 and 394 are coupled by a passage 391, and cavity 396 is coupled to cavity 402 by a passage 403. These cavities or trenches are represented in FIG. 18A by the twin parallel lines coupling the circles representing the cavities. the cavity 392 and traverses the space to a cavity 394 in which resides a second stage ferrimagnetic sphere 396. The half loop coupler descends into the cavity 394, makes a half loop around the ferrimagnetic sphere 396 and terminates at a solder joint 398 on the grounded wall of cavity 394. In the embodiment shown in FIG. 18A, the half loop coupling loop defines a plane which is orthogonal to the plane of the full coupling loop.

Similarly, another half loop coupler 400 starts at a ground connection 402 to the cavity wall of cavity 394, makes a half loop over the ferrimagnetic sphere 396 which is orthogonal to the half loop coupler 390 and rises out of the cavity 394. It then traverses to a cavity 402 in which a third stage ferrimagnetic sphere 404 is supported by a beryllium oxide rod. The half loop coupler 400 then descends into cavity 402, makes a half loop around the ferrimagnetic sphere 404 and terminates in another ground connection at the wall of cavity 402. The size of the cavities may be made small enough that the length of the half loop couplers 390 and 400 from ground connection to ground connection is less than ½ wavelength.

This orthogonal half loop coupling structure is repeated for each of several more ferrimagnetic spheres 406, 408, 410 and 412. The ferrimagnetic sphere 412 serves as the output stage. This sphere is also coupled to a twin wire, full RF loop 414 which has one end grounded at the wall of cavity 416, as represented by connection 417 and the other end coupled to an RF output port 419.

The entire structure is contained within the flux gap 420 between two magnet pole pieces 422 or 424. The magnetic flux intensity in the gap 420 can be fixed for passband filters having a fixed center frequency or variable for a passband which can be tuned.

The length of the full RF coupling loops 384 and 414, the size of the cavities 382 and 416, the size and spacing of the twin wires of the RF loops and the dielectric constant of the dielectric medium filling the flux gap 420 are established in a relationship such that the effective RF length for the full coupling loops is ¼ wavelength at some frequency above 8 GHz and preferably around 12–13 GHz.

In other embodiments, the cavities of the passband filter structure may be staggered so that one row of cavities have their centers offset by half the center to center spacing of neighboring rows. In these embodiments, the half loop RF couplers such as coupler 390 will not be exactly orthogonal to the planes of the full RF coupling loops but will be at a sufficiently large angle that the direct electromagnetic coupling from the full loop RF couplers and the half loop couplers or between neighboring half loop couplers will be acceptably small. All RF coupling from the full loop RF couplers to the half loop couplers or between neighboring half loop couplers should be through the ferrimagnetic spheres. These staggered embodiments are preferred because they keep the length of the ½ loop coupling links shorter thereby easing the problem of the ½ link couplers becoming so long as to approach ½ wavelength which will cause the passband filter to become inoperative.

Details of typically passband structures in which the structure of the invention may be incorporated are shown in U.S. Pat. No. 4,480,238, which is hereby incorporated by reference.

Although the invention has been disclosed in terms of the preferred and alternative embodiments described herein, those skilled in the art will appreciate that numerous modifications and alternative embodiments exist which take advantage of the nonreciprocal coupling properties of the ¼ wavelength full loops with offset spheres. All such modifications and alternative embodiments are intended to be included within the scope of the appended claims and equivalents thereto.

What is claimed is:

1. A ferrimagnetic band reject filter having a passband from approximately two Gigahertz up to approximately eighteen Gigahertz, and having a (1,1,0) Walker mode band reject match with a center frequency which is within said passband, said band reject notch having improved notch characteristics for the notch bandwidth and notch depth over said passband, said band reject filter also having a (2,2,0) Walker mode causing a spurious notch in the passband, comprising:

a tuning magnet having a flux gap therein;

a nonmagnetic, electrically conductive block within said flux gap having a plurality of cavities therein;

a ferrimagnetic sphere within each said cavity;

an RF input for receiving an RF signal to be filtered;

an RF output for outputting a filtered signal;

a plurality of full RF coupling loops, each electromagnetically coupled to one of said ferrimagnetic spheres, and each full RF coupling loop defining a plane adjacent said ferrimagnetic sphere to which said full RF coupling loop is electromagnetically coupled in each said cavity, said RF coupling loops in adjacent cavities being electrically connected together so as to form a transmission line coupling said RF input to said RF output, each said RF coupling loop having an effective electrical length that is ¼ wavelength from the centerline of said RF coupling loop to the centerline of the adjacent RF coupling loop at a design center frequency above 8 Gigahertz, the design center frequency being selected to optimize the notch characteristics of said (1,1,0) Walker mode band reject notch, and wherein the position of said plane of any said full RF coupling loop relative to said ferrimagnetic sphere in each said cavity is individually adjusted so as to simultaneously maximize the depth of said band reject notch created by said (1,1,0) Walker mode while minimizing the depth of or eliminating said spurious notch created by said (2,2,0) Walker mode.

2. The apparatus of claim 1 wherein said band reject notch caused by said (1,1,0) Walker mode is tunable within said passband and wherein said tuning magnet includes means for subjecting all ferrimagnetic spheres to a substantially equal magnetic flux intensity which is selectively variable, and wherein said band reject filter has dielectric filling each said cavity and wherein each said RF coupling loop is made of wire and wherein selected characteristics including the diameter of said RF coupling loops and the distance from loop centerline to loop centerline of adjacent RF coupling loops, the size of each said cavity relative to the size of the RF coupling loop in each cavity, the dielectric constant of the dielectric filling each cavity, the wire size of the wire used to form said RF coupling loops, and the size and spacing of said ferrimagnetic spheres are selected so as to cause a 90 degree phase shift in an RF signal travelling from one RF coupling loop centerline to the next RF coupling loop centerline at said selected design center frequency.

3. The apparatus of claim 2 wherein said design center freqency is approximately 12–13 Gigahertz and wherein said plurality of cavities are arranged so as to be in a substantially straight line, and wherein the position of each ferrimagnetic sphere relative to the plane of the associated RF coupling loop is selected so as to increase the effective Q of said ferrimagnetic spheres at the low frequency end of said passband.

4. The apparatus of claim 1 wherein each said ferrimagnetic sphere has the same $4\pi MS$ saturation magnetization value.

5. The apparatus of claim 3 wherein each said ferrimagnetic sphere has the same $4\pi MS$ saturation magnetization value and wherein each said cavity is separated from neighboring cavities by a wall which is approximately 0.010 inches thick and wherein said cavities are spaced together as close as possible and arranged as two substantially parallel, substantially straight lines 6. A nonreciprocally-coupled, ferrimagnetic passband filter having a passband, comprising:

a tuning magnet having a flux gap;

a nonmagnetic, conductive block in said flux gap and having a plurality of cavities formed therein;

first and second ferrimagnetic spheres, each said sphere suspended in one of said cavities such that said ferrimagnetic spheres are in RF isolation from each other;

an RF input for receiving RF signals to be filtered;

an RF output for outputting filtered RF signals;

a first full RF coupling loop coupled to said RF input on one end and to ground on the other end, and forming a substantially full loop forming a plane which is adjacent to but offset from the center of said first ferrimagnetic sphere, said first RF coupling loop being electromagnetically coupled to said first ferrimagnetic sphere;

a second full RF coupling loop having one end coupled to ground and having a second end coupled to said RF output, said second full RF coupling loop formed as a substantially full loop which is eletromagnetically coupled to said second ferrimagnetic sphere and defining a plane which is adjacent to but offset from the center of said second ferrimagnetic sphere;

an RF coupling link which has a first RF coupling partial loop defining a plane substantially orthogonal to the plane of said first full RF coupling loop so as to prevent substantial direct RF coupling between said first full RF coupling loop and said first RF coupling partial loop of said RF coupling link, said RF coupling link electromagnetically coupled to said first ferrimagnetic sphere, said RF coupling link also having a second RF coupling partial loop which is electromagnetically coupled to said second ferrimagnetic sphere but which is substantially orthogonal to the plane of said second full RF coupling loop so as to prevent substantial direct coupling of RF energy between said second RF coupling partial loop of said RF coupling link and said second full RF coupling loop, thereby forming a path for RF energy to be coupled through ferrimagnetic resonance of said first and second ferrimagnetic spheres from said RF input to said RF output, said RF coupling link having two ends each of which are coupled to ground potential;

and wherein the effective RF length of each said first and second RF coupling loops is such that an RF signal propagating from one end of the loop to the other experiences a 90 degree phase shift at a frequency above 8 Gigahertz, and wherein the position of each of said first and second ferrimagnetic spheres relative to the planes of said first and second full RF coupling loops is selected so as to eliminate or substantially reduce the depth of any (2,2,0) Walker mode spurious notches from the passband of said filter.

7. The apparatus of claim 6 wherein the degree of electromagnetic coupling between said first and second full RF coupling loops and said first and second ferrimagnetic spheres is sufficient to give a wide bandwidth for said passband of at least approximately 500 MHz surrounding a selected center frequency.

8. The apparatus of claim 7 wherein the center frequency of said passband is tunable from approximately 6 to approximately 18 GHz, and wherein said tuning magnet includes means for generating a magnetic flux of selectable intensity such that a center frequency of said tunable passband may be varied within said 6–18 GHz range.

9. The apparatus of claim 6 wherein each full RF coupling loop is comprised of two parallel wires separated by approximately one wire diameter, said two parallel wires being soldered together at one or more points.

10. The apparatus of claim 7 further comprising a plurality of intermediary ferrimagnetic spheres interposed between said first and second ferrimagnetic spheres and a plurality of intermediary partial coupling loops formed in said RF coupling link, and wherein said first and second ferrimagnetic spheres are electromagnetically coupled by said RF coupling link to said plurality of intermediary ferrimagnetic spheres each of said intermediary ferrimagnetic spheres being electromagnetically coupled to a selected one of said plurality of intermediary partial coupling loops of said RF coupling link, said partial coupling loops of said RF coupling link serving to couple RF energy from said first ferrimagnetic sphere to each of said intermediary ferrimagnetic spheres and to said second ferrimagnetic sphere, each of said plurality of intermediary ferrimagnetic spheres also being suspended in a cavity in said block, each said intermediary partial coupling loop of said RF coupling link being at a sufficiently large angle to any full RF coupling loop coupled to the same ferrimagnetic sphere so as to prevent substantial direct RF coupling between said full RF coupling loop and the corresponding intermediary partial coupling loop coupled to the same ferrimagnetic sphere such that substantially all RF coupling between said RF input and said RF output is via excitation of ferrimagnetic resonance in said first and second ferrimagnetic spheres and the intermediary ferrimagnetic spheres via said first and second full RF coupling loops and the RF coupling link.

11. The band reject filter of claim 1 wherein each said full RF coupling loop is comprised of at least two substantially parallel wires separated by approximately one wire diameter and electrically coupled together at points between said cavities and wherein the positions of each ferrimagnetic sphere relative to the planes of the corresponding full RF coupling loop is set so as to maximize the separation between a curve of band reject notch depth versus frequency for a first polarity of the magnetic flux applied by said tuning magnet and the same curve for the opposite polarity of magnetic flux applied by said tuning magnet at a frequency where the effective electrical length seen by said RF signal to be filtered in propagating from the centerline of one RF coupling loop to the centerline of the adjacent RF coupling loop is $\frac{1}{4}$ wavelength.

12. A band reject filter having a passband extending from approximately 2 Gigahertz to approximately 18 Gigahertz and having a band reject notch within said passband, said band reject notch having a tunable center frequency, comprising:

a nonmagnetic, electrically conductive block having a plurality of cavities, said cavities arranged in one or more straight lines, said cavities being spaced close together with walls separating adjacent cavities that are as thin as possible consistent with maintaining sufficient strength to withstand physical forces the band reject filter might encounter in the environment of intended operation, each said cavity wall having at least a conductive surface coupled to ground potential;

a heater block;

a plurality of heater rods anchored in and extending from said heater through said cavity walls into said cavity;

a plurality of ferrimagnetic spheres, attached to the end of a heater rod so as to be suspended in one of said cavities;

an RF transmission line having an input for receiving RF energy to be filtered and having an output at which said filtered RF energy appears and including a plurality of full RF coupling loops each of which couples RF energy to one of said spheres by virtue of being positioned within one of said cavities and adjacent to a corresponding sphere, each RF coupling loop being coupled directly to its neighboring RF coupling loop or loops without any intervening transmission line segment acting as an impedance inverter, each said RF coupling loop defining a plane which does not intersect the center of the sphere to which the RF coupling loop couples RF energy;

a dielectric medium surrounding at least said RF coupling loops and said spheres and filling each said cavity, said dielectric medium having a dielectric constant;

a DC magnetic bias tuning means for subjecting all said ferrimagnetic spheres to a DC magnetic field the intensity of which alters said center frequency;

and wherein said ferrimagnetic spheres resonate in a plurality of Walker modes including a 110 mode which causes said desired band reject notch and a 220 spurious mode which causes an undesired band reject notch;

and wherein each band reject filter has predetermined structural characteristics including the fact that RF coupling loop is made of wire having a predetermined wire diameter and is formed in a generally circular configuration and has a predetermined loop diameter defined by a predetermined loop length, and said RF coupling loop having a predetermined spacing between the edge of the RF coupling loop and the walls of the cavity in which said RF coupling loop resides, and further including the fact that each RF coupling loop is electrically coupled to adjacent RF coupling loops but is spaced from adjacent RF coupling loops by a predetermined centerline-to-centerline spacing, and further including the fact that each cavity is circular and has a predetermined diameter and is separated by adjacent cavities by a cavity wall having a predetermined thickness, and wherein said RF coupling loop length, loop diameter, wire diameter and said spacing between each RF coupling loop and the associated cavity wall, and said cavity diameter, and said wall thickness of the cavity walls separating adjacent cavities and the centerline-to-centerline spacing of said RF coupling loops, and the dielectric constant of said dielectric filling said cavities are selected and coordinated such that an effective RF length from loop centerline to loop centerline of adjacent RF coupling loops exists which results in approximately a 90° phase shift in an RF signal propagating from loop centerline to loop centerline at a design center frequency above 8 Gigahertz, and wherein the position of any ferrimagnetic sphere relative to the plane of the associated RF coupling loop in the same cavity is individually adjusted such that any 110 mode band reject notch depth is maximized and such that any 220 mode spurious band reject notch depth is minimized.

13. The apparatus of claim 12 wherein said structural characteristics are selected and coordinated such that said band reject filter has a design center frequency which results in a band reject notch which is optimized over the entire passband in that the band reject notch 3 dB bandwidth is not substantially greater than approximately 50 MHz at the high frequency end of the passband and such that adequate RF signal rejection or band reject notch depth is achieved at the low frequency end of the passband.

14. The apparatus of claim 12 wherein each said RF coupling loop and said RF transmission line is made of at least two parallel wires separated by approximately one wire diameter and electrically connected together at locations between said cavities.

15. The apparatus of claim 12 wherein each ferrimagnetic sphere has a saturation magnetization and a volume and wherein each RF coupling loop has a loop ratio and wherein each ferrimagnetic sphere volume, saturation magnetization, and loop ratio are selected and coordinated with each other to achieve a bandwidth for said band reject notch of approximately 50 MHz.

16. The apparatus of claim 12 wherein each ferrimagnetic sphere has a saturation magnetization and a volume and wherein each RF coupling loop has a loop ratio and wherein each ferrimagnetic sphere volume, saturation magnetization, and loop ratio are selected and coordinated with each other to achieve a passband from 2 GHz to 18 GHz and a bandwidth for said band reject notch of approximately 50 MHz.

17. The apparatus of claim 12 wherein said ferrimagnetic spheres and cavities are spaced as closely together as is physically possible and the majority of the wire making the electrical connection between any RF coupling loop and its adjacent RF coupling loops is in the RF coupling loops themselves.

18. The apparatus of claim 12 wherein each ferrimagnetic sphere is spaced from adjacent spheres by a center-to-center spacing of approximately 0.050 inches and wherein the cavity diameter is 0.040 inches, and wherein the thickness of the cavity wall between adjacent cavities is 0.010 inches.

19. The apparatus of claim 12 wherein each RF coupling loop is comprised of a plurality of parallel wires and wherein selection of the number of wires in each RF coupling loop, the wire diameter and spacing between the wires and the spacing between the RF coupling loops and the electrically conductive cavity walls and the resulting capacitive coupling between the RF coupling loops and the cavity walls at and the spacing between the RF transmission line and the conductive surface of said nonmagnetic block is such that the capacitive coupling between said RF transmission line and the conductive surface of said nonmagnetic block is coordinated so as to establish a characteristic impedance of said RF transmission line of approximately 50 ohms throughout as much of said passband as possible.

20. A ferrimagnetic band reject filter having a passband from 2–18 Gigahertz and a band reject notch which has a center frequency which is tunable and lies generally within said passband comprising:

an RF input for receiving an RF signal to be filtered;

an RF output at which the RF signal appears after filtering;

a plurality of ferrimagnetic spheres;

means for coupling RF energy received at said RF input to each of said ferrimagnetic spheres so as to apply an RF magnetic field to each said ferrimagnetic sphere and induce 110 Walker mode ferrimagnetic resonance in each sphere to create said band reject notch and 220 Walker mode resonance in each sphere creating an unwanted spurious band reject notch, and for coupling the RF signal filtered by the ferrimagnetic resonances of said spheres to said RF output;

means including a plurality of cavities in a nonmagnetic, but electrically conductive block each of which contains at least one of said ferrimagnetic spheres for creating RF isolation between adjacent ferrimagnetic spheres;

means for applying a D.C. magnetic bias having a tunable intensity level to all said ferrimagnetic spheres at substantially the same selectable intensity level;

and wherein said means for coupling RF energy includes a plurality of full RF coupling loops electrically coupled together, without any intervening transmission line segment acting as an impedance inverter, so as to form an RF transmission line, each RF coupling loop coupling an RF magnetic field to a ferrimagnetic sphere including means for causing an effective RF length between centerlines of adjacent RF coupling loops to be approximately one-quarter wavelength and a characteristic impedance for said RF transmission line of approximately 50 ohms at a design center frequency above 8 Gigahertz, said design center frequency selected so as to achieve the best combination of bandwidth and notch depth of said band reject notch at both the high frequency end and the low frequency end of said passband, and including means for implementing nonreciprocal coupling thereby maximizing the depth of said band reject notch created by said 110 Walker mode while minimizing the depth of said band reject notch created by said 220 Walker mode.

* * * * *